US008555790B2

(12) United States Patent
Winter et al.

(10) Patent No.: US 8,555,790 B2
(45) Date of Patent: Oct. 15, 2013

(54) FOLDING TABLE

(75) Inventors: David C. Winter, Layton, UT (US); Jay Calkin, Layton, UT (US); Mitch Johnson, South Weber, UT (US); Joel H. Bennett, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 7 days.

(21) Appl. No.: 13/195,801

(22) Filed: Aug. 1, 2011

(65) Prior Publication Data

US 2012/0024203 A1 Feb. 2, 2012

Related U.S. Application Data

(60) Provisional application No. 61/370,057, filed on Aug. 2, 2010.

(51) Int. Cl.
*A47B 3/00* (2006.01)

(52) U.S. Cl.
USPC ..... 108/132

(58) Field of Classification Search
USPC ..... 108/115, 35, 38, 36, 167, 169, 168, 108/173, 174, 132, 129, 130, 131
See application file for complete search history.

(56) References Cited

U.S. PATENT DOCUMENTS

| | | | | |
|---|---|---|---|---|
| 2,643,926 | A * | 6/1953 | Pucci | 108/131 |
| 3,368,504 | A * | 2/1968 | Cohen | 108/131 |
| 5,357,872 | A * | 10/1994 | Wilmore | 108/35 |
| 5,540,158 | A | 7/1996 | Ford | |
| 6,058,853 | A * | 5/2000 | Pinch | 108/129 |
| 6,752,091 | B2 * | 6/2004 | Glover et al. | 108/168 |
| 7,140,308 | B2 * | 11/2006 | Tsai | 108/169 |
| 7,278,361 | B2 * | 10/2007 | Zhurong et al. | 108/168 |
| 7,735,431 | B2 * | 6/2010 | Neunzert et al. | 108/132 |
| 7,757,617 | B2 * | 7/2010 | Larcom et al. | 108/132 |
| 8,091,490 | B2 * | 1/2012 | Branch et al. | 108/169 |
| 2004/0094076 | A1 | 5/2004 | Jin | |
| 2006/0219138 | A1 | 10/2006 | Lin et al. | |

OTHER PUBLICATIONS

International Search Report and Written Opinion from PCT/US2011/046281, dated Jan. 17, 2012.

* cited by examiner

*Primary Examiner* — Jose V Chen

(74) *Attorney, Agent, or Firm* — Maschoff Brennan

(57) ABSTRACT

A foldable table may include a table top and legs that are movable between an extended position and a collapsed position. The table top may include a first section and a second section that are movable between folded and unfolded positions. A first portion of a side rail may be connected to the first section of the table top and a second portion of the side rail connected to the second section of the table top. A hinge assembly may connect the first and second portions of the side rail in an offset configuration. When the table is in the folded position, an inner surface of the first portion of the side rail may be disposed at least proximate an outer surface of the second portion of the side rail.

20 Claims, 14 Drawing Sheets

FOLDING TABLE

CROSS-REFERENCE TO RELATED APPLICATION

The present application claims priority to and the benefit of U.S. Provisional Patent Application Ser. No. 61/370,057, entitled TABLE, which was filed on Aug. 2, 2010, and is hereby incorporated by reference in its entirety.

BACKGROUND OF THE INVENTION

1. Field of the Invention

The present invention generally relates to furniture and, in particular, to tables that are capable of being disposed in a folded position and an unfolded position.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. When the tables are no longer needed, the table legs can be moved into the storage position and the tables may be moved or stored.

Conventional banquet tables with collapsible legs may allow the table to be more conveniently stored. The table top for many conventional banquet tables with collapsible legs, however, retains its size and shape. For example, many known banquet tables have a length between six to ten feet and a width between three to four feet. As a result, many conventional banquet tables require a large storage area even when the legs are in the collapsed position. This large storage area may be especially problematic for large facilities such as hotels, schools and churches because a considerable number of these table may have to be stored. Thus, a considerable amount of space may be required to store the tables. In addition, smaller facilities such as restaurants, offices and homes may use one or more conventional banquet tables. These smaller facilities may use the tables less frequently, such as during special occasions. Conventional banquet tables, even when the legs are folded, are often too bulky and obstructive to be conveniently used and stored at such smaller facilities. As a result, it is often necessary for both larger and smaller facilities to rent and/or borrow one or more banquet tables when needed. Disadvantageously, this process of renting and/or borrowing banquet tables can be inconvenient, time consuming and costly.

In addition, conventional banquet tables are often difficult to move or transport from one location to another. For example, because of the length of many conventional banquet tables, the tables are often problematic to move by a single person. In addition, the extended length of the banquet tables may preclude the tables from being transported in the trunk or back seat of a typical passenger car. Accordingly, conventional banquet tables may have to be transported by a truck, trailer or oversized vehicle such as a sports utility vehicle. These and other factors may make conventional banquet tables difficult, time consuming and relatively expensive to move, especially if a number of such tables need to be moved at the same time.

It is also known to construct tables that are capable of being folded-in-half. In particular, conventional fold-in-half tables typically include a table top with two sections that are pivotally connected by hinges. The two sections usually have the same size and shape, and the hinges are typically located at the center or middle of the table top. The two sections of the table top may be moved between an unfolded position in which the sections of the table top are generally aligned in the same plane and a folded position in which the two sections are positioned generally adjacent to each other for storage.

Disadvantageously, many conventional fold-in-half tables with foldable table tops are unstable and unable to support a significant amount of weight. For example, the connection of the two sections of the table top for many known fold-in-half tables is relatively weak, which may allow, for example, a portion of the table top to sag. In particular, the center or middle portion of the table top may undesirably sag. Additionally, the connection of the table top sections for many known fold-in-half tables may also be relatively frail and may break if a significant load or force is applied to the table top. In order to construct a stronger table top, it is known to make the sections of the table tops out of stronger and thicker materials. Undesirably, this may increase the weight of the table top, which may make the table more difficult to carry and move.

An additional shortcoming of many conventional tables with foldable table tops is the hinges may be connected to the table top sections by a plurality of screws. Undesirably, the structural integrity of the table top may be decreased by the numerous holes created by the plurality of screws, which may allow the table top to collapse and fail. In addition, because the screws are typically individually attached to the table top, the time required to construct the table may be significantly increased.

BRIEF SUMMARY OF EMBODIMENTS OF THE INVENTION

A need therefore exists for a table that eliminates or diminishes the disadvantages and problems described above.

One aspect is a table that may include a table top and one or more legs that may be used to support the table top in a use or support position. The legs are preferably movable between an extended or use position and a collapsed or storage position relative to the table top. When the legs are in the use position, the legs preferably extend outwardly and away from the table top. For example, the legs may be disposed generally perpendicular to the table top in the use position. When the legs are in the collapsed position, the legs are preferably disposed generally parallel and at least proximate a lower or underneath portion of the table top. At least a portion of the legs may contact or abut the lower portion of the table top when the legs are in the collapsed position. Advantageously, when the legs are in the use position, the table may be used to support a wide variety of objects and the table may be used for a variety of different purposes. When the legs are in the collapsed position, that may facilitate moving, storing and transportation of the table.

Another aspect is a table that may include a table top that is capable of being moved between folded and unfolded positions. For example, the table top may include two sections that are generally aligned in the same plane when the table top is in the unfolded position and the two sections may be generally positioned parallel and adjacent to each other when the table top is in the folded position. The table may also include legs that are movable between the use and collapsed positions. Advantageously, if the table includes both a foldable table top and legs that can be selectively moved between the use and collapsed positions, then the table may be stored in a relatively compact area. This may also allow, for example, a single person to easily move and transport the table. In addition, this may allow the table to be positioned in a relatively small area, such as the backseat or trunk of an automobile. Further, this may allow one or more tables to be shipped and/or stored in relatively small areas, which may allow transportation and storage costs to be decreased.

Yet another aspect is a table that may include a table top constructed from plastic and the plastic table top is preferably constructed using a blow-molding process. Advantageously, this may allow a lightweight table top to be easily constructed and it may allow the table top to have various desired shapes, sizes, configurations and designs. This may also allow a table top to be constructed that is generally weather resistant and temperature insensitive, which may allow the table to be used in a wide variety of locations and environments. In addition, this may allow a table top that is durable, long-lasting and corrosion resistant to be constructed. Further, because a table top constructed from blow-molded plastic may be relatively strong, the table may be used to support a relatively large amount of weight. Significantly, a table top constructed from blow-molded plastic may also form a structural member of the table. The table top may also be supported by other structures, such as a frame.

Advantageously, a table top constructed from blow-molded plastic may be relatively strong because it may include opposing walls or surfaces that are separated by a distance. In particular, the opposing walls may be separated by a generally constant distance and the table top may have generally uniform characteristics and features, which may help create a table top with generally uniform properties such as strength and structural integrity. In addition, because a hollow interior portion may be formed during the blow-molding process, that may allow a lightweight table top to be created. Thus, the blow-molded plastic table top may be both lightweight and strong. The table top could also be formed from other suitable processes, such as injection, rotational, extrusion, vacuum or thermoforming processes, and the table top could be constructed using other appropriate materials.

Still another aspect is a table that may include a frame attached to the first and second sections of the table top. The frame may be sized and configured to allow the table top to be moved between the folded and unfolded positions. For example, the frame may include rails, such as side rails, connected to the first and second sections of the table top and one or more hinge assemblies may connect the rails. Advantageously, the frame rails may be offset to allow the thickness of the table to be decreased when the table is in the collapsed position. In addition, the hinge assemblies may be specifically designed and configured to allow the frame rails to be offset. Significantly, the offset rails and hinge assemblies may allow a strong and sturdy folding table to be created. In contrast, previous known folding tables had the side rails aligned in order to create a table with sufficient strength. Additionally, previous known folding tables used a hinge to directly connect the aligned side rails. Thus, the side rails and hinge of previous known folding tables were aligned.

A further aspect is a table that may include a cross member and the frame may be connected to the cross member. In particular, the cross member may be generally centrally disposed and the first and second sections of the table top may rotate about an axis of rotation that is generally aligned with the cross member. The frame may include two side rails that are each connected to the central cross member. The table may also include legs that are connected to cross members located at least proximate opposing ends of the table top. The leg cross members may be connected to a portion of the frame, such as the rails.

A still further aspect is table that may include a table top with first and second sections and a frame with first and second side rails. The first and second side rails may be connected to the first and second sections of the table top, and the side rails may be pivotally connected by hinge assemblies. The hinge assemblies preferably allow the side rails to be disposed in an offset configuration. For example, a first portion of the first side rail may be connected to the first section of the table top and a second portion of the first side rail may be connected to the second section of the table top. The first and second portions of the first side rail are preferably offset and/or not aligned. For instance, the first portion of the first side rail may be generally aligned with a first plane and the second portion of the first side rail may be generally aligned with a second plane, and the first and second planes may be offset or spaced apart by a distance. In particular, the first and second planes may be disposed in a generally parallel configuration, separated by a gap and/or disposed at an angle.

Yet another further aspect is a table that may be disposed in a more compact configuration in the collapsed position than a conventional folding table. For example, because the strength and rigidity of a table may be directly proportional to the height and width of the side rails of the frame, decreasing the height and/or width of the side rails may undesirably decrease the strength and/or rigidity of the table. It may also be desirable to maintain the height and width of the side rails so that the more compact folding table has the size general size, strength and other characteristics as a conventional folding table. That is, if the frame of the more compact folding table has generally the same shape and size as a conventional folding table, then it may have the same general strength, rigidity and characteristics of a conventional folding table. Additionally, if the size of the side rails is decreased, then consumers and retailers may assume the table has less strength and rigidity than a conventional folding table. When a conventional folding table is in the collapsed position, it has a thickness at least twice the height of the side rails plus the thicknesses of the first and second sections of the table top. Specifically, conventional folding tables in the collapsed position have a thickness of the first section of the table top, the first portion of the side rail, the second portion of the side rail and the second section of the table top. The table with the more compact folding frame, however, may have generally the same strength, rigidity and other characteristics as a conventional table because the height and width of the side rails may be relatively unchanged but the table may be disposed in a more compact configuration because the rails are offset. This may advantageously allow the table to have a decreased overall height or thickness in the folded position because of the offset side rails.

Another aspect is a table that may include cross members with receiving portions that are sized and configured to receive portions of the side rails when the table is in a folded position. Exemplary receiving portions may include recesses, notches, openings, channels, grooves, dents, cut-outs and the like. Desirably, the receiving portions may allow the table in the collapsed position to be disposed in a more compact configuration. For example, one or more legs may be connected to a first cross member and the first cross member may be connected to the side rails of the frame. One or more legs may also be connected to a second cross member and the second cross member may be connected to the side rails of the frame. The first cross member may include receiving portions that receive a portion of the side rails when the table is in the folded position. In addition, the second cross member may include receiving portions that receive a portion of the side rails when the table is in the folded position. This may advantageously decrease the overall thickness of the table in the folded position because it may no longer be necessary to have the side rails positioned above or below the first and second cross members when the table is in the folded position. It will be appreciated that the receiving portions are not required and the side rails may be positioned entirely above and/or below the cross members when the table is in the folded position.

Yet another further aspect is a table that may include cross members with receiving portions that face away from a lower surface of the table top when the legs of the table are in the collapsed position and face towards an outer edge or end of the table top when the legs are in the use position. If the receiving portions extend towards an outer edge or end of the table top when the legs are in the use position, this may advantageously prevent the receiving portions from significantly impacting the strength of the cross members while the table is being used. If the receiving portions are disposed away from the lower portion of the table top when the legs are in the collapsed position, this may allow a portion of the rails to be disposed in the receiving portions when the table is in the folded position. It will be appreciated that the receiving portions may be disposed in other suitable directions depending, for example, upon the particular size, shape, configuration and/or arrangement of the table.

Still another aspect is a table that may include cross members with receiving portions that have a generally concave or inwardly curved shape. This may facilitate, for example, a portion of the side rail being nested or disposed within the receiving portions. In addition, the concave shape may help position the rails in the desired locations when the table is in the folded position. This may also help in alignment of the table top sections in the folded position and assist in locking or securing the table in the folded position. The receiving portions, however, do not require a concave shape and may have other suitable shapes, sizes, configurations and arrangements.

A further aspect is a table that may include a frame with rails that at least partially overlap and/or interlock when the table is in the collapsed position. For example, the table may include a first side rail with a first portion connected to a first section of the table top and a second portion connected to a second section of the table top. The first and second portions of the rail may be at least partially aligned and connected by a hinge assembly. The first portion of the rail may include a receiving portion and the second portion of the rail may include an engaging portion. The receiving portion may include one or more inwardly extending portions, such as recesses, notches, openings, channels, grooves, dents, cutouts and/or the like. The engaging portion is desirably sized and configured to be disposed within the receiving portion when the table is in the folded position. Advantageously, this may allow the table to have a decreased overall thickness because at least a portion of the second side rail may be disposed in the receiving portion of the first side rail. It will be appreciated, however, that the receiving and/or engaging portions of the side rails are not required.

Another further aspect is a table that may include a frame with one or more receiving and engaging portions in which an engaging portion is sized and configured to be disposed in a receiving portion when the table is in the folded position. For example, a first portion of a side rail may include a receiving portion and a second portion of the side rail may include an engaging portion. The engaging portion may be at least partially disposed in the engaging portion when the table is in the folded position. The first portion of the side rail may also include one or more receiving and engaging potions. The second portion of the side rail may further include one or more receiving and engaging portions. The engaging and receiving portions may be sized and configured to interact when the table top is in the folded position. For instance, an engaging portion of the first portion of the side rail may be disposed in a receiving portion of the second portion of the side rail. In addition, an engaging portion of the second portion of the side rail may be disposed in a receiving portion of the first portion of the side rail when the table is in a folded position.

A still further aspect is a table that may include a hinge assembly that allows portions of the frame or rail to be offset. For example, the hinge assembly may be connected to a cross member and the cross member may be disposed along a pivot axis. The hinge assembly may include a first bracket connected to a first portion of the rail and a second bracket connected to a second portion of the rail. The brackets may be connected to the cross member and the brackets may be spaced apart to allow the portions of the rail to be offset. In addition, the table may include first and second leg assemblies connected to the first and second table top sections, respectively. The table may further include a first brace including an end connected to the cross member and another end connected to the first leg assembly, and a second brace including an end connected to the cross member and another end connected to the second leg assembly. The cross member may facilitate folding of the table and help secure the braces in the desired positions. The braces may be configured to move between use and collapsed positions as the legs are moved between the use and collapsed positions.

Another further aspect is a table that may include one or more components that are offset. For instance, if the frame rails are offset, this may allow other components of the table to be offset such as the legs and/or braces. In greater detail, if a first portion of a side rail is disposed towards a first side of the first section of the table top, then the legs and brace of the first portion of the table top may also be disposed towards the first side of the table top. Similarly, if the second portion of the side rail is disposed towards a second side of the second section of the table top, then the legs and brace of the second portion of the table top may be disposed towards the second side of the table top. Advantageously, the various components may be offset by generally the same distance. For example, the rails, legs and/or braces may be offset by a generally constant distance. In addition, the rails, legs and/or braces on the first side of the table may be offset by a first distance and the rails, legs and/or braces on the second side of the table may be offset by a second distance. If desired, the rails, legs and/or braces may be offset by generally the same distance but it will be appreciated that the different components may be offset by different distances.

Yet another further aspect is a table that may be more efficiently packaged, stored and/or transported. For example, incorporating one or more of the above-described features may advantageously allow about 1,200 tables to be stored in a standard shipping container, while only 1,020 tables that lack such features could be stored in a standard shipping container. Thus, the features described above may allow about seventeen percent (17%) more tables to be shipped in a standard shipping container, which may significantly reducing shipping costs. In another example, a conventional folding table may include first and second sections that have a height of about 1.5 inches and the table may have a thickness of at least 3.0 inches in the folded position. The features described above may allow a folding table to have first and second sections that have a height of about 1.5 inches and with similar strength, rigidity and characteristics as a conventional folding table, but only a thickness of about 2.5 inches in the folded position. This may decrease the thickness of the table in the folded position by about seventeen percent (17%). Significantly, this may allow six tables with a thickness of about 2.5 inches in the folded position to be disposed in the same space as five tables with a thickness of about 3.0 inches. This may also allow twenty-four tables including one or more of these features described above to be disposed in the same space as twenty tables with a thickness of about 3.0 inches. Importantly, the features disclosed above may allow a plurality of tables to be more efficiently stored, stacked, shipped, packaged and transported. This may significantly reduce costs for the manufacture because transportation costs may be decreased, allow retailers to more efficiently store and display the tables, and allow businesses, consumers and purchasers to save a considerable amount of space.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain FIGS. of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is directed towards a table that is capable of being moved between folded and unfolded positions. The principles of the present invention, however, are not limited to tables that are capable of being moved between folded and unfolded positions. It will be understood that, in light of the present disclosure, the invention disclosed herein can be successfully used in connection with other types of tables, furniture and the like.

Additionally, to assist in the description of the table, words such as top, bottom, front, rear, right and left are used to describe the accompanying figures. It will be appreciated, however, that the present invention can be located in a variety of desired positions, including various angles, sideways and even upside down. In addition, the drawings may be to scale and may illustrate various configurations and arrangements of the table, but the drawings are not necessarily to scale and the table may have other suitable shapes, sizes, configurations and arrangements depending, for example, upon the intended use of the table. A detailed description of the table now follows.

Figure 1:
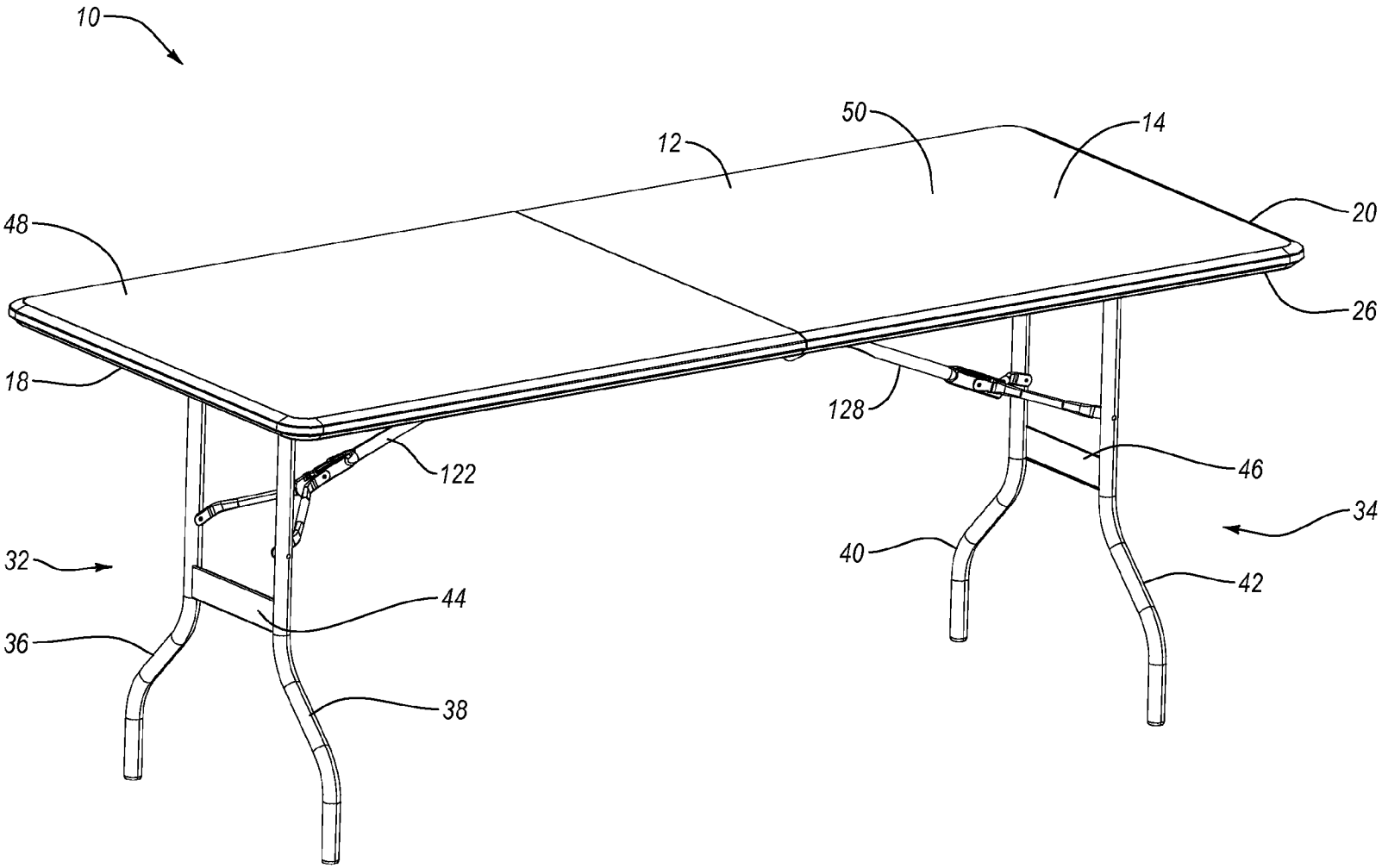
FIG. 1 is a perspective view of an exemplary table, illustrating the table in an unfolded position.
Figure 2:
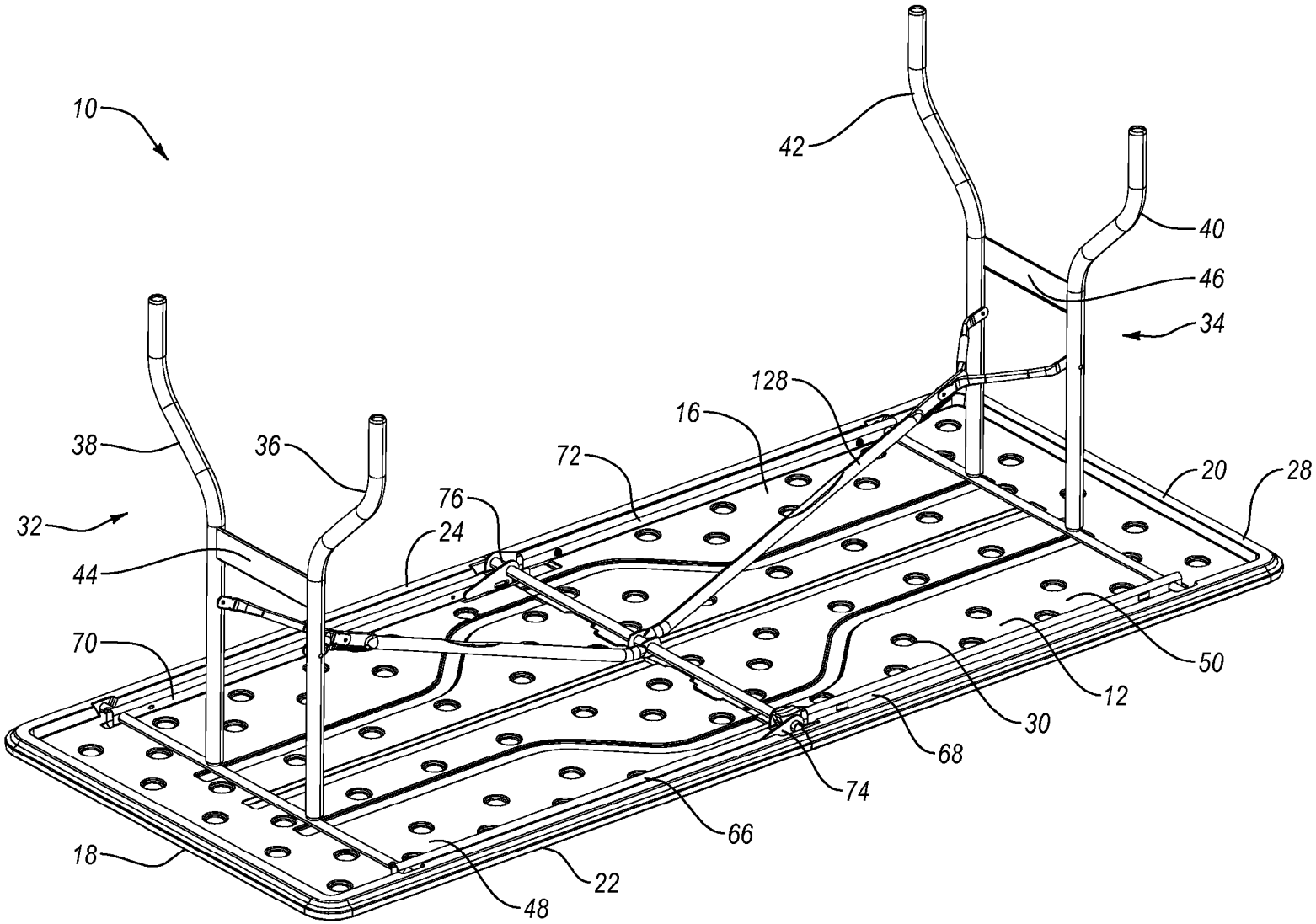
FIG. 2 is a lower perspective view of the table shown in FIG. 1.

As seen in FIGS. 1 and 2, the table 10 may include a table top 12 with an upper surface 14, a lower surface 16, a first end 18, a second end 20, a front portion 22 and a rear portion 24. The upper surface 14 of the table top 12 is preferably generally planar to create a working surface, but the upper surface could also be textured and have other suitable configurations depending, for example, upon the intended use of the table 10. The table top 12 may also include an edge 26 that is disposed about the outer perimeter or periphery of the table top. All or a portion of the edge 26 may be beveled, sloped or rounded to, for example, increase the comfort and safety of the user. The table top 12 may also include a downwardly extending lip 28 disposed near or proximate the outer portion of the table top. The lip 28 preferably extends downwardly beyond the lower surface 16 of the table top 12 and the lip may be aligned with or form a part of the edge 26 of the table top. It will be appreciated that the lip 28 may also be spaced inwardly from the edge 26 of the table top 12. The lip 28, edge 26, table top 12 and/or table 10 may have other appropriate shapes, sizes, configurations, arrangement and features, such as disclosed in U.S. Pat. Nos. 6,530,331; 7,111,563; 7,475,643; 7,814,844; 7,975,625; each of which are incorporated by reference in its entirety.

The table top 12 preferably has a generally rectangular configuration with rounded corners and slightly rounded edges 26. The table top 12 may have a relatively large size and the table to may be configured for use as a banquet or utility table. For example, the table top 12 may have a length of about five feet (or about sixty inches) and a width of about two and one-half feet (or about thirty inches), but the table top can be larger or smaller. For instance, the table top 12 could be six or eight feet in length, and the table top could be two or three feet in width. One skilled in the art will appreciate that the table top 12 can be larger or smaller according, for example, to the intended use of the table 10. Additionally, the table top 12 may have other suitable shapes and configurations such as square, circular, oval, and the like depending, for example, upon the intended use of the table 10. In addition, the corners, edges and other portions of the table top 12 could have various desired shapes, sizes, configurations and arrangements depending upon the intended use of the table 10. Further, the table 10 could be any suitable type of table such as a card table, personal table, and the like.

The table top 12 is preferably constructed from a lightweight material and, more preferably, the table top is constructed from plastic, such as high density polyethylene. The plastic table top 12 is desirably formed by a blow-molding process because it may allow a relatively strong, lightweight, rigid and sturdy table top to be quickly and easily manufactured. Advantageously, the blow-molded plastic table top 12 may be lighter weight than conventional table tops constructed from wood or metal. In addition, the blow-molded plastic table top 12 may be lightweight because it may include a hollow interior portion formed during the blow-molding process.

The table top 12 is preferably constructed from blow-molded plastic because blow-molded plastic table tops are relatively durable, weather resistant, temperature insensitive, corrosion resistant, rust resistant and generally do not deteriorate over time. One of ordinary skill in the art will appreciate that, after reading the disclosure herein, the table top 12 could be constructed from other suitable materials and/or processes. For example, the table top 12 may be constructed from other types of plastics, polymers and synthetic materials and different processes such as injection molding, rotational molding and the like. In addition, the table top 12 may be constructed from other materials with sufficient strength and desirable characteristics such as plywood, particle board, solid wood, wood slates, metal alloys, fiberglass, ceramics, graphite and the like.

Figure 3:
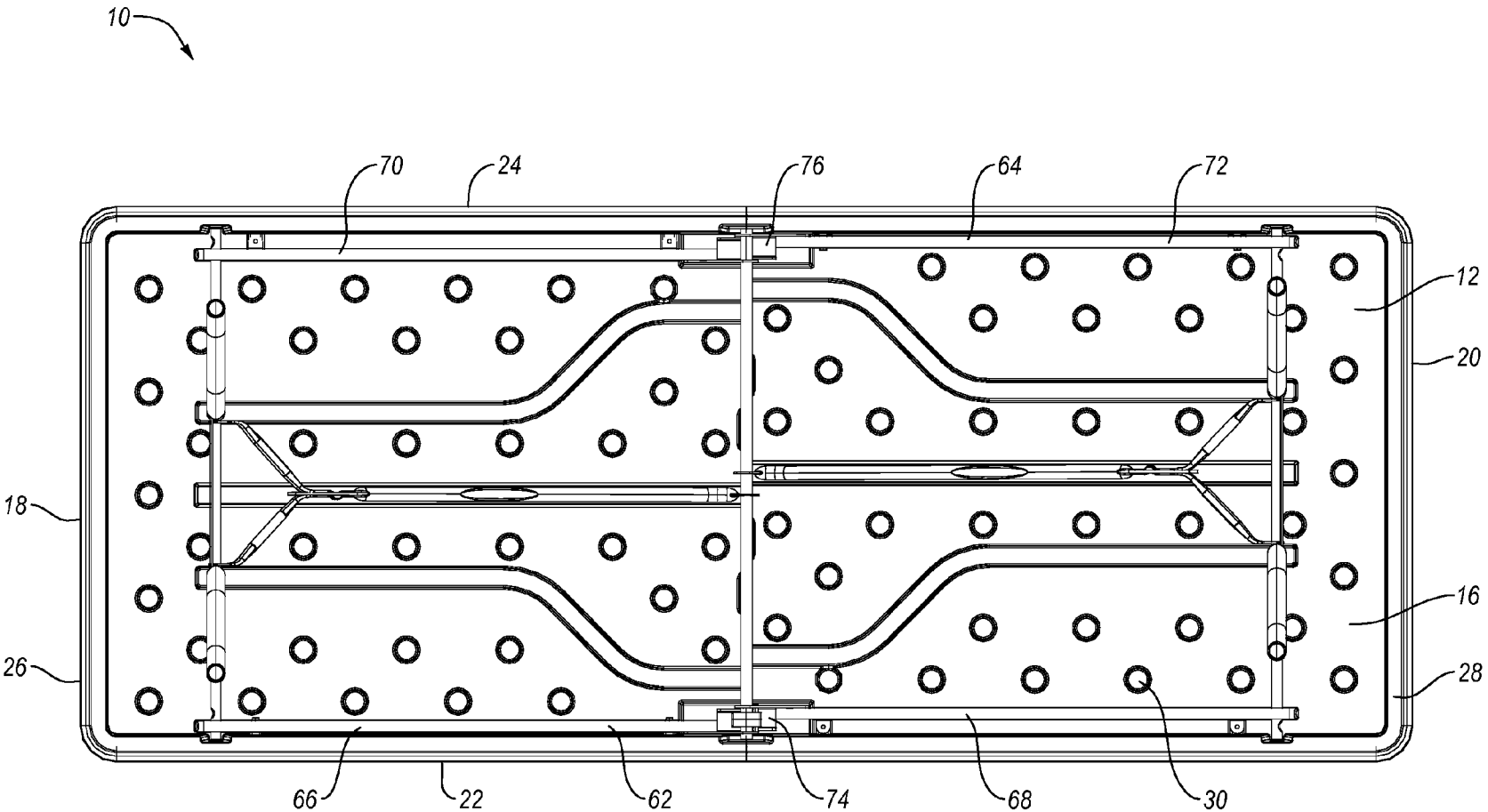
FIG. 3 is a bottom view of the table shown in FIG. 1.
Figure 4:
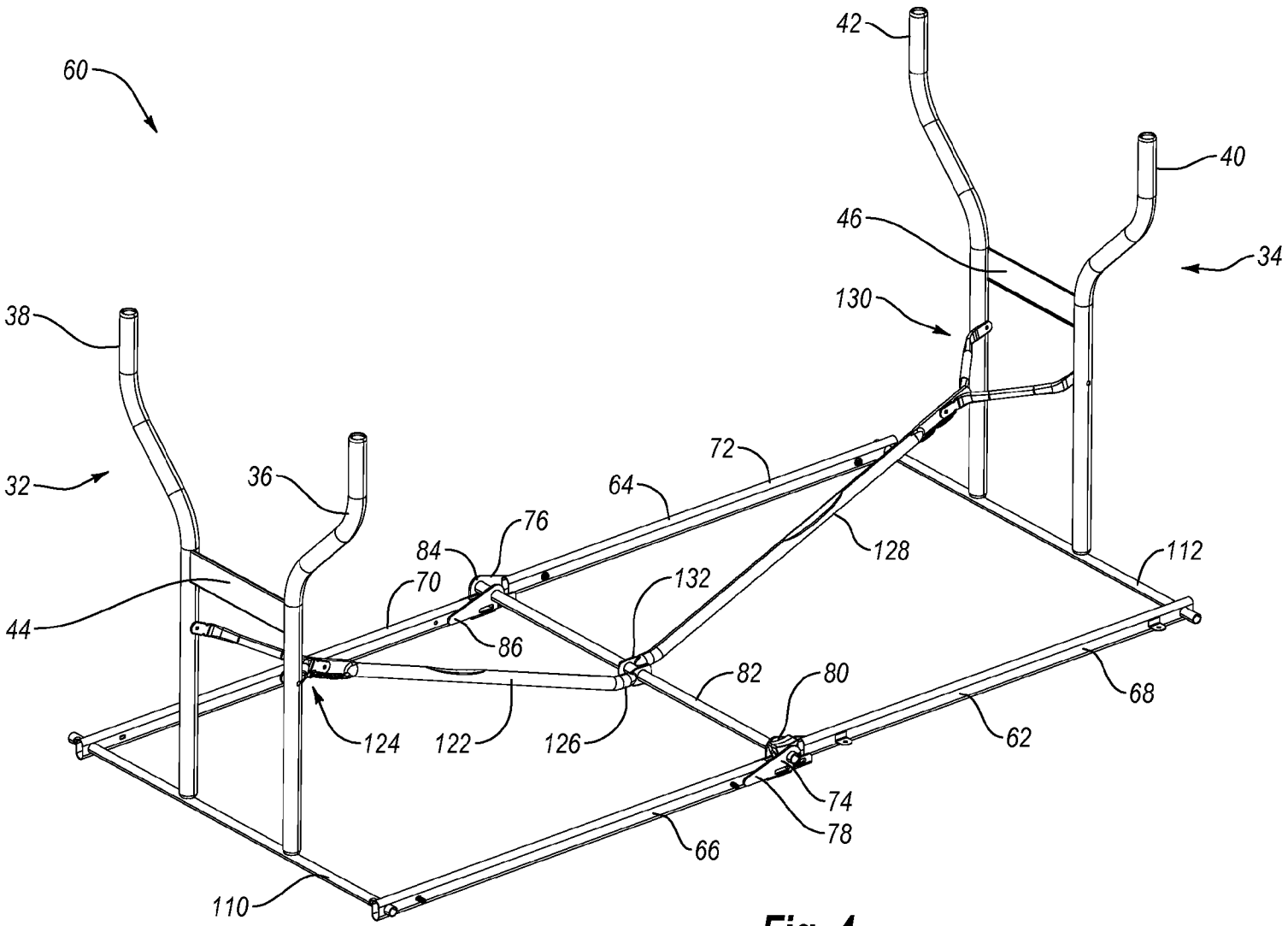
FIG. 4 is a perspective view of a portion of the table shown in FIG. 1, illustrating the frame.
Figure 5:
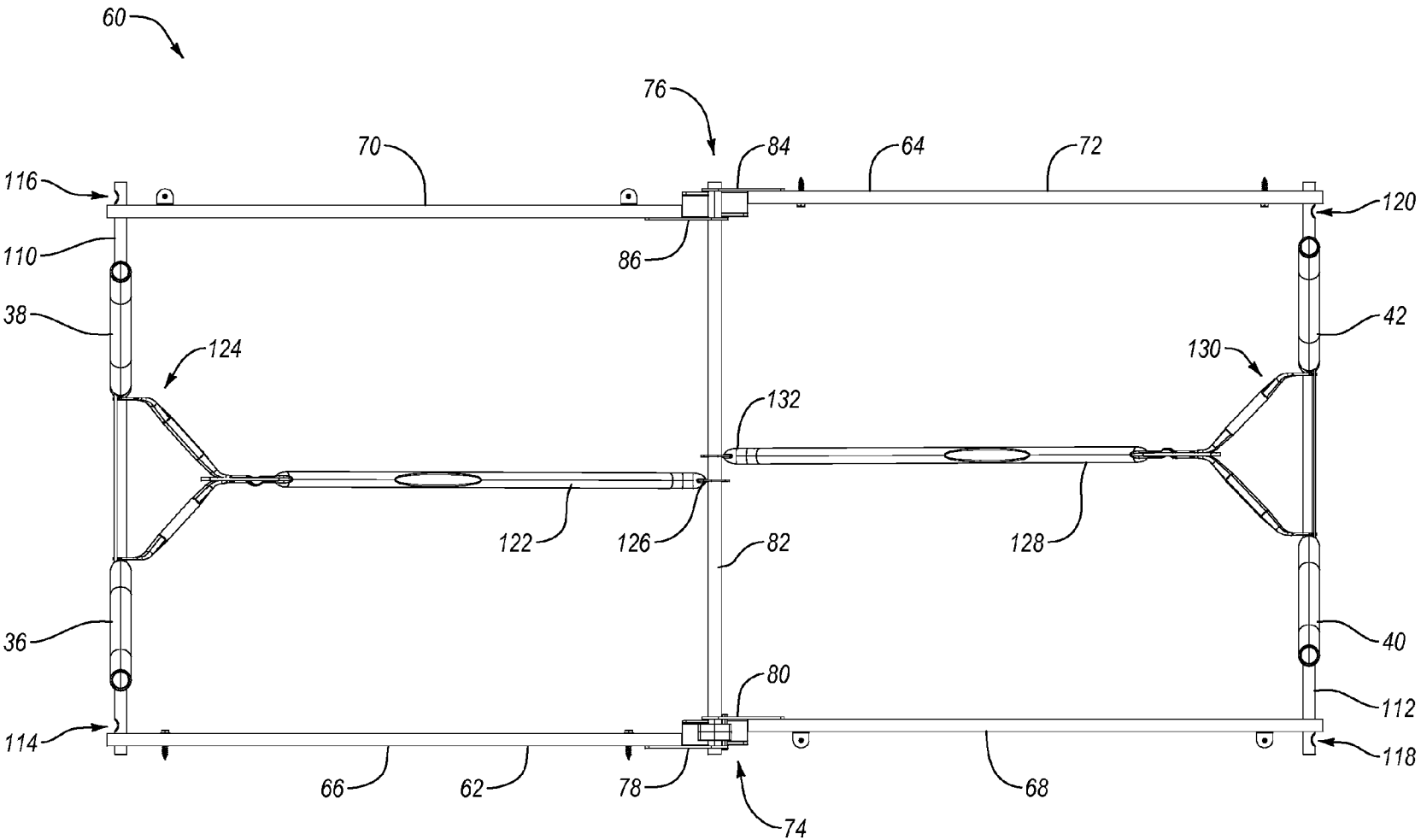
FIG. 5 is a bottom view of the portion of the table shown in FIG. 4.

The upper surface 14 and the lower surface 16 of the table top 12 may be spaced apart by a distance and the spaced apart surfaces may help create a strong and rigid table top 12. If desired, the upper and lower surfaces 14, 16 may be separated by a generally constant distance and the surfaces may be generally aligned in parallel planes. The table top 12 may also include one or more tack-offs, kiss-offs or depressions 30. For example, as shown in the accompanying figures, the depressions 30 may be disposed in the lower surface 16 of the table top 12. The depressions 30 may be sized and configured to increase the strength and rigidity of the table top 12. The depressions 30 may also be used to create a table top 12 with more uniform properties and characteristics. Advantageously, the depressions 30 can be integrally formed with the table to 12 as part of a unitary, one-piece structure. The depressions 30, and other portions of the table 10, may have other shapes, sizes, configurations, arrangement and features, such as disclosed in U.S. Pat. Nos. 7,069,865; 7,114,453; 7,143,702; and 7,210,277; and U.S. patent publication no. 2006-0230989; each of which are incorporated by reference in its entirety In greater detail, the depressions 30 preferably extend towards the upper surface 14 of the table top 12 and the ends of the depressions 30 may contact or engage the upper surface of the table top 12, or the ends of the depressions may be spaced from the upper surface of the table top. As shown in FIGS. 2 and 3, the depressions 30 may be disposed over substantially the entire lower surface 16 of the table top 12. It will be appreciated that the depressions 30 may cover only a portion of the table top 12 and the depressions could be formed in any desired portion of the table top.

The table 10 may include one or more leg assemblies 32, 34 which may be sized and configured to support the table top 12 above a surface. The leg assemblies 32, 34 may include one or more supports 36, 38, 40, 42, and the supports may be connected by a connecting member 44, 46, respectively, as seen in FIGS. 1 and 2. As shown in FIGS. 2 and 3, the leg assemblies 32, 34 may be movable between an extended or use position and a collapsed or storage position relative to the table top 12. It will be appreciated the legs assemblies 32, 34; supports 36, 38, 40, 42; and connecting members 44, 46 may have other suitable shapes, sizes, configurations and arrangements depending, for example, upon the intended use of the table 10.

The table 10 may also include a table top 12 with a first section 48 and a second section 50. As shown in the accompanying figures, the first leg assembly 32 may be movable between the extended and collapsed positions relative to the first section 48 of the table top 12. The second leg assembly 34 may be movable between the extended and collapsed positions relative to the second section 50 of the table top 12.

Figure 6:
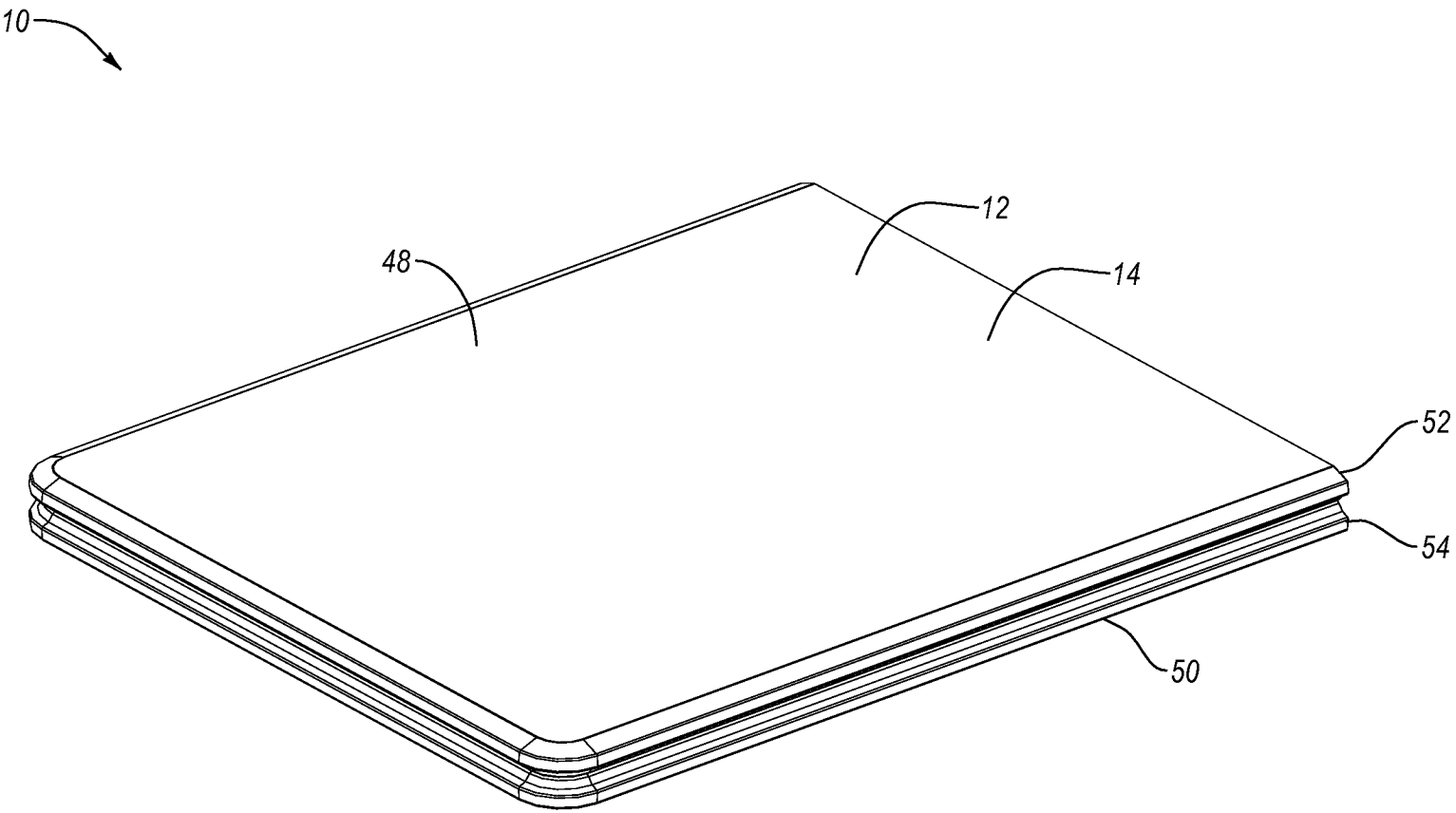
FIG. 6 is another perspective of the table shown in FIG. 1, illustrating the table in a folded position.
Figure 7:
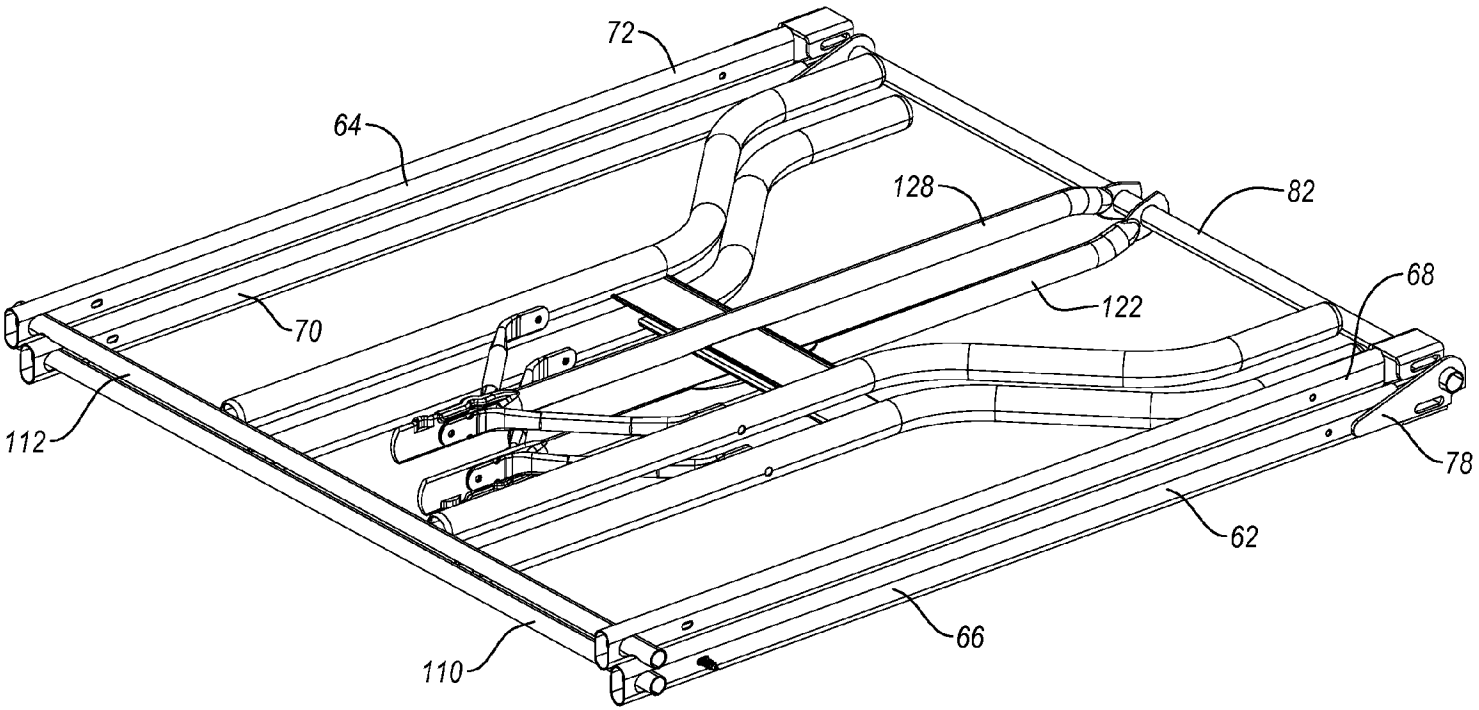
FIG. 7 is still another perspective of a portion of the table shown in FIG. 1, illustrating the frame in a folded position.
Figure 8:
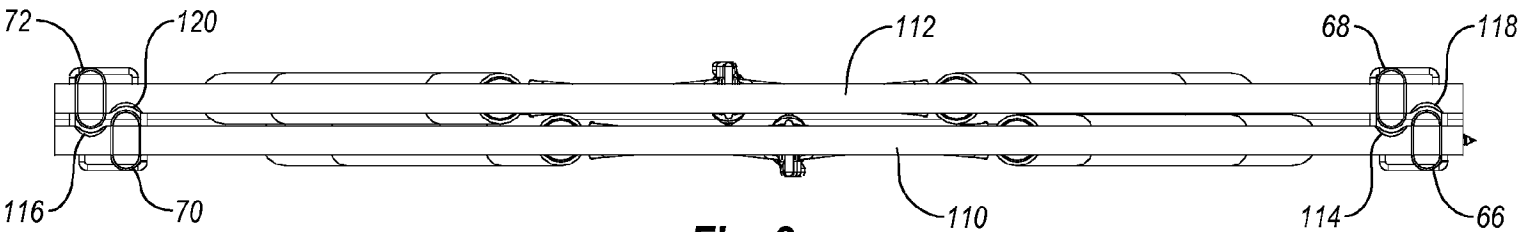
FIG. 8 is an end view of the portion of the table shown in FIG. 7.
Figure 9:
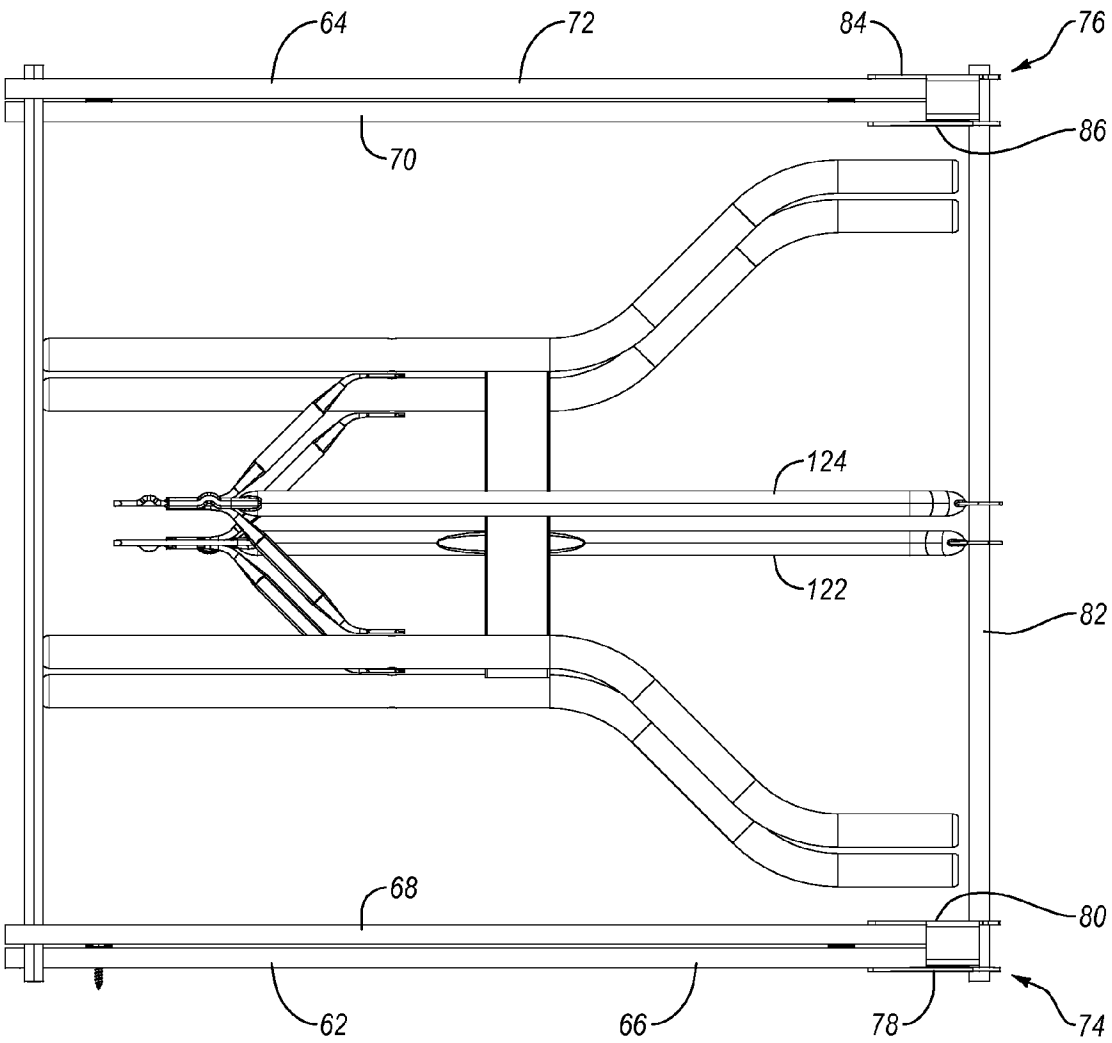
FIG. 9 is a top view of the portion of the table shown in FIG. 7.

The first and second sections 48, 50 of the table top 12 may be foldable about an axis between an unfolded position, such as shown in FIGS. 1-3, and a folded position as shown in FIG. 6. The first and second sections 48, 50 are preferably generally aligned in the same plane when the table top 12 is in the unfolded position and the table top sections are preferably disposed generally adjacent and parallel to each other when in the folded position.

The first and second sections 48, 50 of the table top 12 may have a generally rectangular configuration and may have a generally symmetrical or mirror-image configuration. In addition, the first and second sections 48, 50 of the table top 12 may include inner surfaces 52, 54 that are sized and configured to contact and/or engage when the table top is in the unfolded position. The inner surfaces 52, 54 of the table top 12 may then be spaced apart when the table top is in the folded position. The inner surfaces 52, 54 may also overlap and/or interlock as shown in U.S. Pat. No. 7,096,799, which is incorporated by reference in its entirety.

The table 10 may further include a frame 60 that is connected to the table top 12. As seen in FIGS. 2 and 3, the frame 60 may connected to the lower surface 16 of the table top 12. The frame 60 may include one or more rails, channels, support members or the like. For example, the frame 60 may include rails, such as side rails 62, 64, that extend along a length of the table top 12. The side rails 62, 64 may be positioned near opposing sides or edges 26 of the table top 12. The side rails 62, 64 may also be disposed at least proximate the lip 28. In addition, there may be a gap or space between the side rails 62, 64 and the edge 26 and/or lip 28. The side rails 62, 64 preferably extend almost the entire length of the table top 12, which may provide increased strength and rigidity for the table top, but the side rails may extend along only a portion of the table top and the side rails may not be required to provide increased strength or rigidity to the table top.

In greater detail, the first side rail 62 may be disposed towards a first side of the table top 12 and the first side rail may include a first portion 66 connected to the first section 48 of the table top and a second portion 68 connected to the second section 50 of the table top. The second side rail 64 may be disposed towards a second side of the table top 12 and the second side rail may include a first portion 70 connected to the first section 48 of the table top and a second portion 72 connected to the second section 50 of the table top.

The side rails 62, 64 may be pivotally connected by hinge assemblies 74, 76, respectively. The hinge assemblies 74, 76 may allow the side rails 62, 64 to be disposed in an offset configuration. In particular, the first and second portions 66, 68 of the first side rail 62 are preferably not aligned and the first and second portions 70, 72 of the second side rail 64 are preferably not aligned. For example, the first portion 66 of the first side rail 62 may be generally aligned with a first plane and the second portion 68 of the first side rail may be generally aligned with a second plane, and the first and second planes may be offset, spaced apart by a distance and/or disposed at an angle. For instance, the first and second planes may be disposed in a generally parallel configuration, separated by a gap and/or disposed at an angle. Similarly, the first portion 70 of the second side rail 64 may be generally aligned with a third plane and the second portion 72 of the second side rail may be generally aligned with a fourth plane. The third and fourth planes may be offset, spaced apart by a distance, disposed in a generally parallel configuration, separated by a gap and/or disposed at an angle. If desired, some or all of the portions 66, 68, 70, 72 of the first and second side rails 62, 64 may be disposed in a generally parallel configuration and spaced apart by a distance. As an example, the first and second portions 66, 68 of the first side rail 62 may be spaced apart by a distance and the first and second portions 70, 72 of the second side rail 64 may be spaced apart by the same distance. In another example, the first portions 66, 70 of the first and second side rails 62, 64 may be spaced apart by a distance and the second portions 68, 72 of the first and second side rails may be spaced apart by the same distance.

The hinge assemblies 74, 76 may allow the table 10 to be moved between the folded and unfolded positions. For example, the first hinge assemble 74 may pivotally connect the first and second portions 66, 68 of the first side rail 62 and the second hinge assembly 76 may pivotally connect the first and second portions 70, 72 of the second side rail. In greater detail, the hinge assembly 74 may include a first bracket 78 that is connected to the first portion 66 of the first side rail 62 and a second bracket 80 that is connected to the second portion 68 of the first side rail. The first and second brackets 78, 80 are preferably connected. For example, a cross member 82 may connect the brackets 78, 80 of the first hinge assembly 74. The cross member 82 may also be used to connect a first bracket 84 and a second bracket 86 of the second hinge assembly 76. In particular, the cross member 82 may be generally centrally disposed along a length of the table top 12 and the first and second sections 48, 50 of the table top 12 may rotate about an axis that is generally aligned with the cross member. The brackets 78, 80, 84, 86 of the hinges assemblies 74, 76 may have generally the same size, shape and configuration, which may facilitate manufacturing and assembly of the table 10. For convenience, only the brackets 78 and 80 will be described in greater detail below, and it will be appreciated that the brackets 84, 86 may have similar sizes, shapes, configurations and arrangements. It will also be appreciated that the brackets 78, 80, 84, 86 and the hinges assemblies 74, 76 may have other suitable sizes, shapes, configurations and arrangements depending, for example, upon the size, shaped and/or intended use of the table 10.

Figure 11:
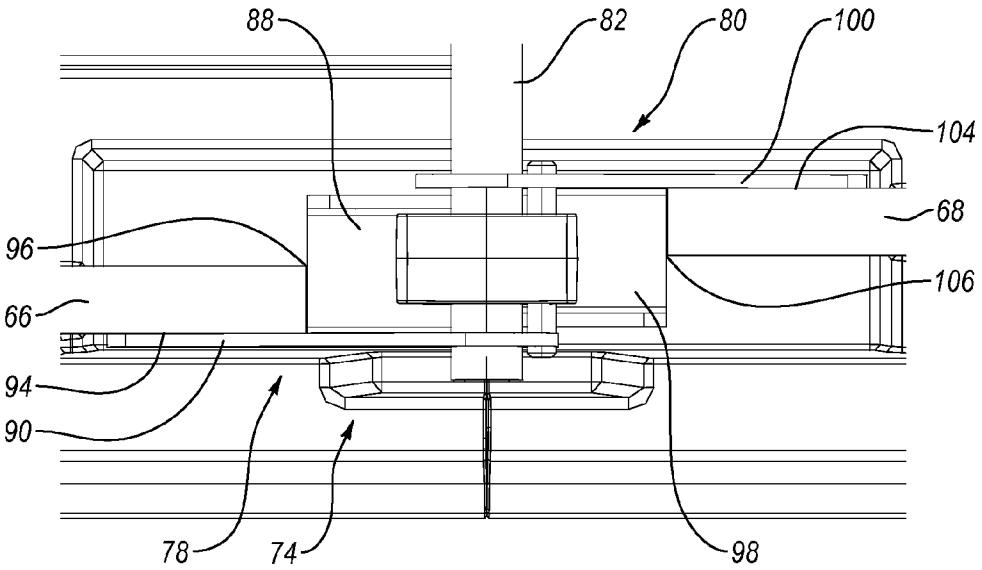
FIG. 11 is an enlarged bottom view of another portion of the table shown in FIG. 1.
Figure 10:
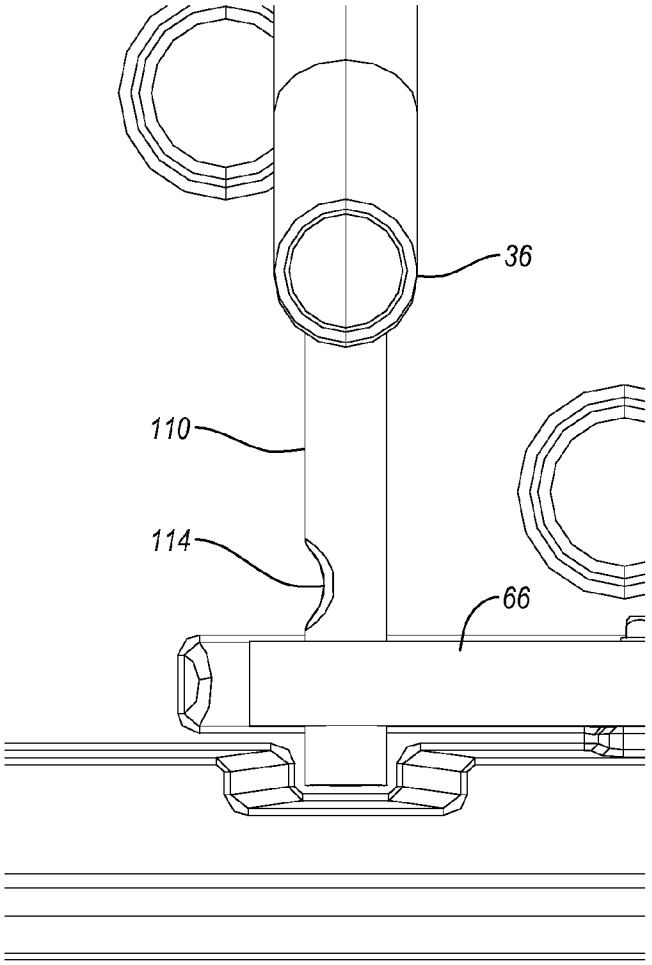
FIG. 10 is an enlarged bottom view of a portion of the table shown in FIG. 1.

The bracket 78 may include a body 88 and a flange 90, which may be disposed at an angle relative to the body, such as a right angle, so that the bracket has a generally L-shaped configuration. The body 88 may be connected to and/or disposed proximate the lower surface 16 of the table top 12 and the flange 90 may include an aperture 92 that is sized and configured to receive the cross member 82. The bracket 78 may also include one or more surfaces that are sized and configured to contact and/or be attached to the frame 60. For example, the bracket 78 may include a first surface 94 that is sized and configured to contact and/or be attached to a first part of the first portion 66 of the first side rail 62 and a second surface 96 that is sized and configured to contact and/or be attached to a second part of the first portion of the first side rail. As shown in FIG. 11, the first surface 94 may be disposed on an inner surface of the flange 90 and the second surface 96 may be disposed on a lower surface of the body 88. This may allow, for instance, the first surface 94 to be connected to a portion of the first side rail 62 disposed towards an outer portion of the table top 12, such as the lip 28, and the second surface 96 to be connected to a portion of the first side rail 62 disposed towards the lower surface 16 of the table top 12. Thus, the body 88 may be disposed or sandwiched between the upper portion of the first side rail 62 and the lower surface 16 of the table top 12. Additionally, the flange 90 may be disposed or sandwiched between the inner surface of the lip 28 and an outer portion of the first side rail 62.

The bracket 80 may have generally the same size, shape and configuration as the bracket 78. For example, the bracket 80 may have a body 98, a flange 100, an aperture 102 that is sized and configured to receive the cross member 82, a first surface 104 that is sized and configured to contact and/or be attached to a first part of the second portion 68 of the first side rail 62, and a second surface 106 that is sized and configured to contact and/or be attached to a second part of the second portion of the first side rail. As shown in FIG. 11, the first surface 104 may be disposed on an inner surface of the flange 100 and the second surface 106 may be disposed on a lower surface of the body 98. This may allow, for instance, the first surface 104 to be connected to an inner portion of the second portion 68 of the first side rail 62 that is disposed towards an inner portion of the table top 12, and the second surface 106 to be connected to a portion of the first side rail 62 disposed towards the lower surface 16 of the table top 12. Thus, the body 98 may be disposed or sandwiched between the upper portion of the first side rail 62 and the lower surface 16 of the table top 12. Additionally, the flange 90 may be disposed or sandwiched between the inner portion of the first side rail 62 and the inner portion of the table top 12.

The brackets 78, 80, 84, 86 of the first and second hinge assemblies 74, 76 may be sized and configured to help position the first and second portions 66, 68, 70, 72 of the first and second side rails 62, 64 in the offset configuration. For example, in this configuration, the flanges 90, 100 may be spaced apart by a distance generally equal to or larger than a width of the first and second portions 66, 68 of the first side rail 62. The bodies 88, 98 may also have a width generally equal to or larger than a width of the first and second portions 66, 68 of the first side rail 62. In addition, the bodies 88, 98 may contact, abut and/or engage when the table top 12 is in the unfolded position, which may help increase the strength and/or rigidity of the table 10. For example, in the unfolded position, at least a portion of the bodies 88, 98 may overlap and/or interlock.

The leg assembles 32, 34 may be connected to the frame 60 by one or more cross members. For example, a first cross member 110 may connect the first leg assembly 32 to the side rails 62, 64 of the frame 60 and a second cross member 112 may connect the second leg assembly 34 to the side rails of the frame. As shown in the accompanying figures, the ends of the cross members 110, 112 may be disposed within or extend through openings in the side rails 62, 64 of the frame 60, which may allow the cross members to be pivotally connected to the table top 12. The cross members 110, 112 may also be connected to the frame 60 in other suitable configurations and arrangements, such as shown in U.S. Pat. No. 7,100,518, which is incorporated by reference in its entirety. The cross members 110, 112 may also be connected to other portions of the frame 60, table top 12 and/or table 10.

The cross members 110, 112 may include one or more receiving portions that are sized and configured to receive a portion of the frame 60 when the table top 12 is in the folded position. In particular, the first cross member 110 may include a first receiving portion 114, which may be disposed between the frame 60 and the first leg assembly 32, and a second receiving portion 116, which may be disposed beyond or past the outer surface of the first portion 70 of the second side rail 64. In greater detail, the first receiving portion 114 may be disposed between the first portion 66 of the first side rail 62 and the support 36 of the first leg assembly 32, and the second receiving portion 116 may be disposed proximate the outer surface of the first portion 70 of the second side rail 64. The first receiving portion 114 is preferably disposed at least proximate the first portion 66 of the first side rail 62 and the second receiving portion 116 is preferably disposed at least proximate the first portion 70 of the second side rail 64. The second cross member 112 may include corresponding first and second receiving portions 118, 120.

The receiving portions 114, 116, 118, 120 may consist of inwardly extending portions disposed in an outer surface of the first and second cross members 110, 112. In greater detail, the cross members 110, 112 may have a generally circular, oval, oblong or other suitable configuration and the receiving portions 114, 116, 118, 120 may include recesses, notches, openings, channels, grooves, dents, cut-outs and the like. Advantageously, the receiving portions 114, 116, 118, 120 may allow the table 10 to be disposed in a more compact configuration in the collapsed configuration. For example, the first receiving portion 114 of the first cross member 110 may be sized and configured to receive a portion of the second portion 68 of the first side rail 62 when the table top 12 is folded. The second receiving portion 116 of the first cross member 110 may be sized and configured to receive a portion of the second portion 72 of the second side rail 64 when the table top 12 is folded. Similarly, the first and second receiving portions 118, 120 of the second cross member 112 may be sized and configured to receive portions of the first and second side rails 62, 64 when the table top 12 is folded. This may allow the overall thickness of the table 10 in the folded position to be decreased.

The receiving portions 114, 116, 118, 120 in the first and second cross members 110, 112 preferably face downwardly and away from the lower surface 16 of the table top 12 when the leg assemblies 32, 34 of the table 10 are in the collapsed position. If the receiving portions 114, 116, 118, 120 are disposed outwardly and away from the lower surface 16 of the table top 12 when the leg assemblies 32, 34 are in the collapsed position, this may allow portions of the side rails 62, 64 to be disposed in the receiving portions when the table 10 is in the folded position. The receiving potions 114, 116, 118, 120 may face towards the outer edge 26 or the ends 18, 20 of the table top 12 when the leg assemblies 32, 34 are in the use position. If the receiving portions 114, 116, 118, 120 extend towards the outer edge 26 or the ends 18, 20 of the table top 12 when the leg assemblies are in the use position, this may advantageously prevent the receiving portions from impacting the strength of the cross members 110, 112. It will be appreciated that the receiving portions 114, 116, 118, 120 may be disposed in other suitable portions of the cross members 110, 112 and/or directions depending, for example, upon the particular size, shape, configuration and/or arrangement of the table 10.

The receiving portions 114, 116, 118, 120 preferably have a generally concave or inwardly curved shape because this may facilitate disposing portions of the side rails 62, 64 in the receiving portions. Significantly, if the side rails 62, 64 are nested within the receiving portions 114, 116, 118, 120, then this may help position the table 10 in the desired configuration in the folded position. In addition, the concave shape may help position the side rails 62, 64 in the desired locations when the table 10 is in the folded position. This may also help in alignment of the table top sections 48, 50 in the folded position and assist in locking or securing the table 10 in the folded position. The receiving portions 114, 116, 118, 120 may also have other suitable shapes, sizes, configurations and arrangements depending, for example, upon the type of side rails 62, 64 and/or frame 60.

The table 10 may further include a first brace 122 including a first end 124 connected to the first leg assembly 32 and a second end 126 connected to the cross member 82, and a second brace 128 including a first end 130 connected to the second leg assembly 34 and a second end 132 connected to the cross member. The braces 122, 128 may help secure the leg assemblies 32, 34 in the use position and may help facilitate movement of the leg assemblies between the use and collapsed positions. The braces 122, 128 may also be size and configured to move between a use position and a collapsed position as the leg assembles 32, 34 are moved between the use and collapsed positions.

As discussed above, the hinge assemblies 74, 76 may be sized and configured to allow the side rails 62, 64 of the frame 60 to be offset. If the side rails 62, 64 are offset, this may allow other components of the table 10 to be offset, such as the leg assemblies 32, 34 and/or the braces 122, 128. In greater detail, if the first portion 66 of the first side rail 62 is disposed towards a first side of the first section 48 of the table top 12, then the leg assembly 32 and the brace 122 may also be disposed towards the first side of the table top. If the second portion 68 of the first side rail 62 is spaced apart from the first side of the second section 50 of the table top 12, then the leg assembly 34 and the brace 128 of the second portion of the table top may also be spaced apart from the first side of the second section of the table top. Similarly, if the first portion 70 of the second side rail 64 is spaced apart from a second side of the first section 48 of the table top 12, then the leg assembly 32 and the brace 122 may also be spaced apart from the second side of the first section of the table top. Further, if the second portion 72 of the second side rail 64 is disposed towards the second side of the second section 50 of the table top 12, then the leg assembly 34 and the brace 128 may be disposed towards the second side of the table top. Advantageously, these various components may be offset by generally the same distance. For example, the first and second portions 66, 68, 70, 72 of the side rails 62, 64; the leg assemblies 32, 34; and/or the braces 122, 128 may be offset by a generally constant distance. In addition, the first portions 66, 70 of the side rails 62, 64; the leg assembly 32; and/or the brace 122 on the first section 48 of the table top 12 may be offset by a first distance and the second portions 68, 72 of the side rails, the leg assembly 34 and/or the brace 128 on the second section 50 of the table top may be offset by a second distance. If desired, the first and second portions 66, 68, 70, 72 of the side rails 62, 64; the leg assemblies 32, 34; and/or the braces 122, 128 may be offset by generally the same distance but it will be appreciated that the different components may be offset by different distances.

Figure 13:
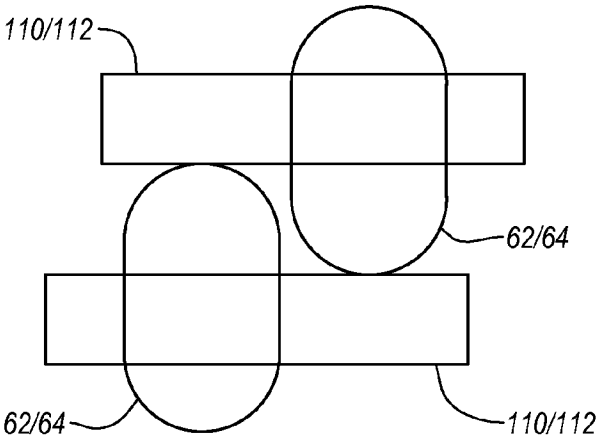
FIG. 13 is a diagram illustrating an exemplary arrangement and configuration of side rails and cross members for a table.
Figure 14:
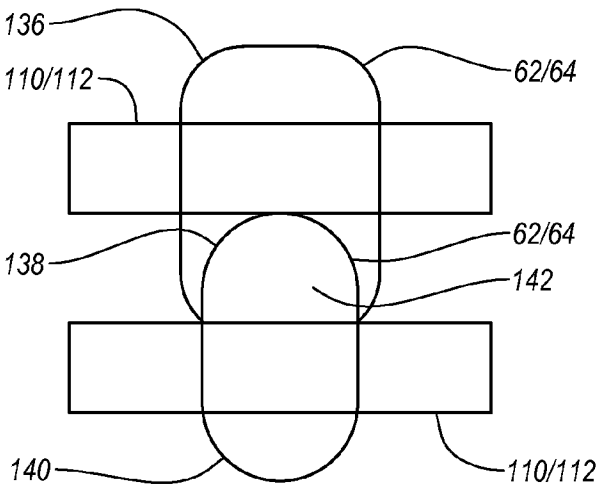
FIG. 14 is a diagram illustrating another exemplary arrangement and configuration of side rails and cross members for a table.
Figure 12:
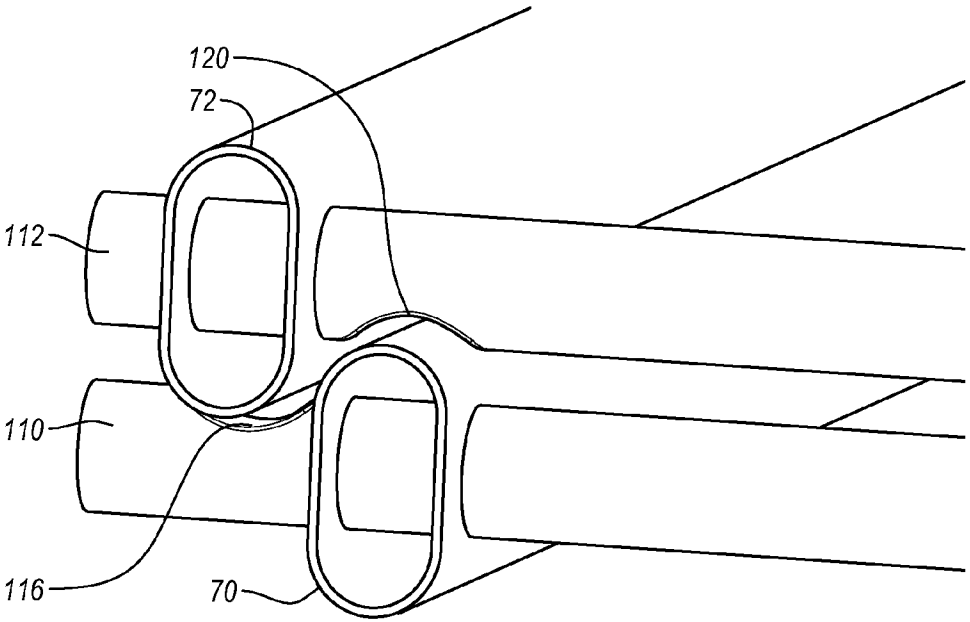
FIG. 12 is an enlarged perspective view of a portion of an exemplary table.

The offset configuration of the first and second portions 70, 72 of the second side rail 64 and the receiving portions 116, 120 is illustrated in FIGS. 12 and 13. The side rails 62, 64, however, do not have to be offset. For example, as shown in FIG. 14, portions of the frame 60 may overlap when the table 10 is in the collapsed position. In particular, the side rails 62, 64 may at least partially overlap and/or interlock when the table 10 is in the collapsed position. For example, the first portion 66 of the first side rail 62 may at least partially overlap with the second portion 68 of the first side rail when the table 10 is in the folded position. In this instance, the first and second portions 66, 68 of the first side rail 62 may be at least partially aligned.

In greater detail, as seen in FIG. 14, a first portion 136 of the first or second side rail 62, 64 may include a receiving portion 138 and a second portion 140 of the first or second side rail may include an engaging portion 142. The receiving portion 140 may include one or more inwardly extending portions, such as recesses, notches, openings, channels, grooves, dents, cut-outs and/or the like. The engaging portion 142 is desirably sized and configured to be disposed within the receiving portion 140 when the table 10 is in the folded position. Advantageously, this may allow the table 10 to have a decreased overall thickness because at least part of the engaging portion 142 may be disposed in the receiving portion 138 when the table is in the folded position.

In greater detail, for example, the first portions 66, 70 of the first and second side rails 62, 64 may include receiving portions 138 and the second portions 68, 72 of the first and second side rail 62, 64 may include engaging portions 142. The engaging portions 142 may be at least partially disposed in the receiving portions 138 when the table 10 is in the folded position. It will be appreciated that the side rails 62, 64 may include any suitable number and arrangement of the receiving and engaging potions 138, 142.

As shown in FIGS. 15-19, another exemplary embodiment of a table 200 may have some of the same components and features as the table 10 described above. For convenience and brevity, the same reference numbers used above may be used in connection with the same or similar components of the table 200. For example, the table 200 may include leg assemblies 32, 34 in which the supports 36, 38, 40, 42 and the connecting members 44, 46 have a different configuration than shown in connection with the table 10. For instance, as shown in the accompanying figures, the supports 36, 38, 40, 42 may have an elongated, generally tubular configuration that are disposed proximate the corners of the frame 60. The supports 36, 38 may be disposed inwardly from the side rails 62, 64 and the supports 40, 42 may be spaced outwardly from the side rails. The connecting member 44 may consist of a generally straight rod, tube or member connecting the supports 36, 38. The connecting member 46 may also consist of a generally straight rod, tube or member and it may also include first and second receiving portions 202, 204 that are sized and configured to receive a portion of the leg assembly 32 when the table 200 is in the folded position, as described in more detail below. The frame 60 may also include receiving portions 206, 208, 210, 212 that are disposed in the side rails 62, 64. In particular, the receiving portions 206, 208 may be disposed in the first portions 66, 70 of the first and second side rails 62, 64 and the receiving portions 210, 212 may be disposed in the second portions 68, 72 of the first and second side rails. The table 200 may further include one or more braces connected to the leg assemblies 32, 34 and the frame 60. For example, slotted braces 214, 216, 218, 220 may be connected to the leg assemblies 32, 34 and the frame 60. The slotted braces 214, 216, 218, 220 may help control movement of the leg assemblies 32, 34 relative to the frame 60 and may secure the leg assemblies in a fixed position.

Figure 15:
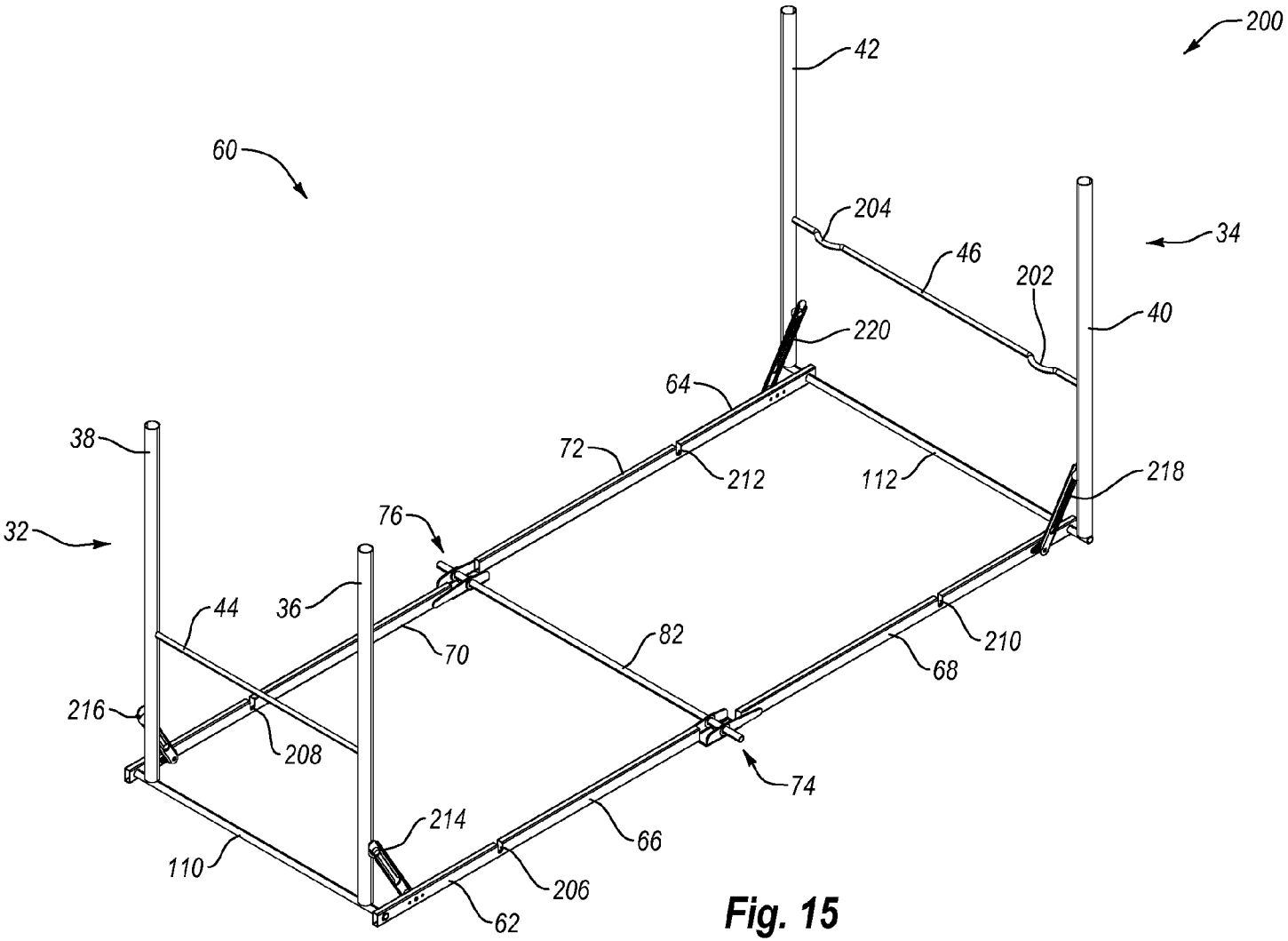
FIG. 15 is a perspective view of an exemplary frame for a table.
Figure 16:
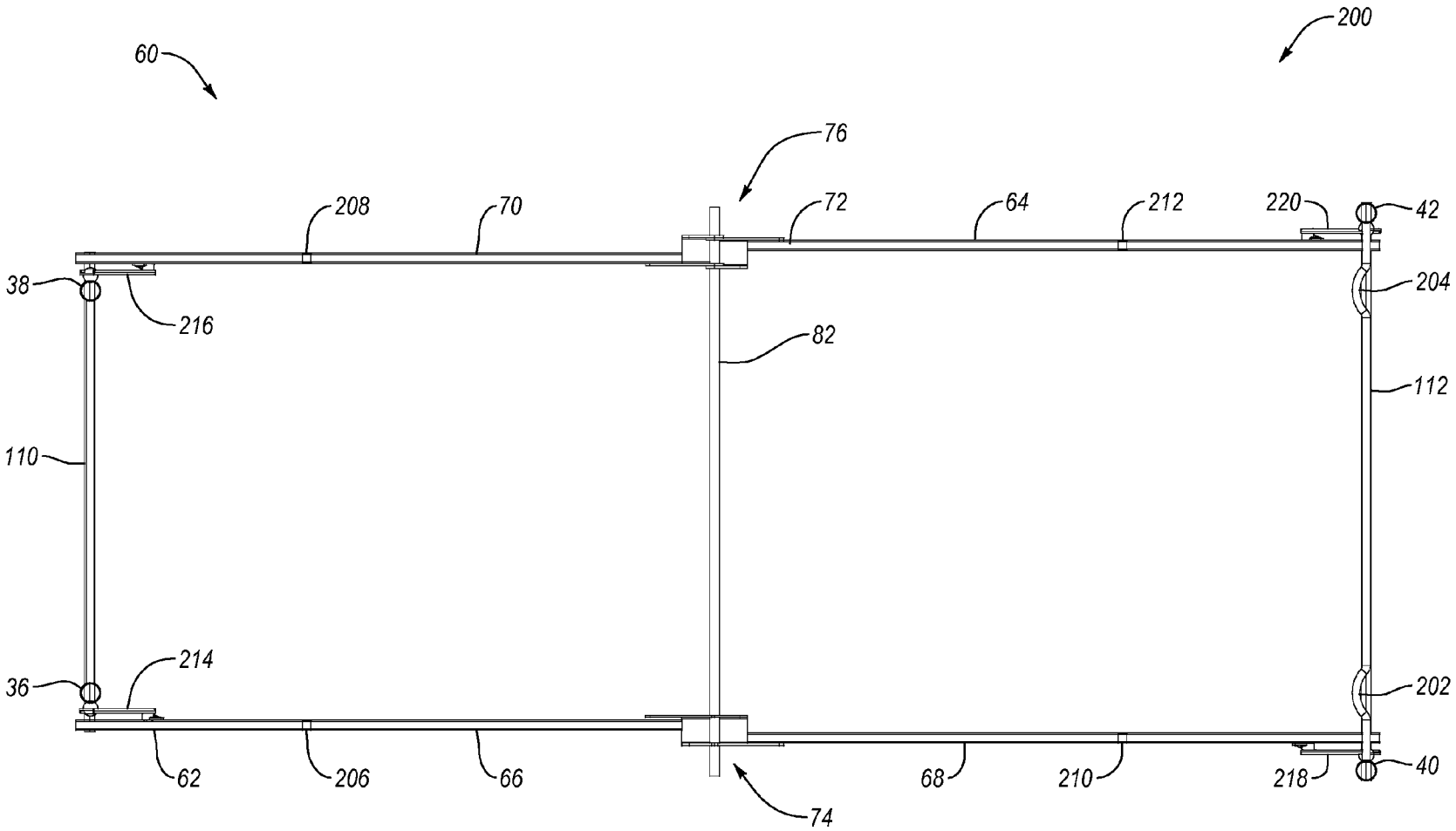
FIG. 16 is a top view of the frame shown in FIG. 15.
Figure 17:
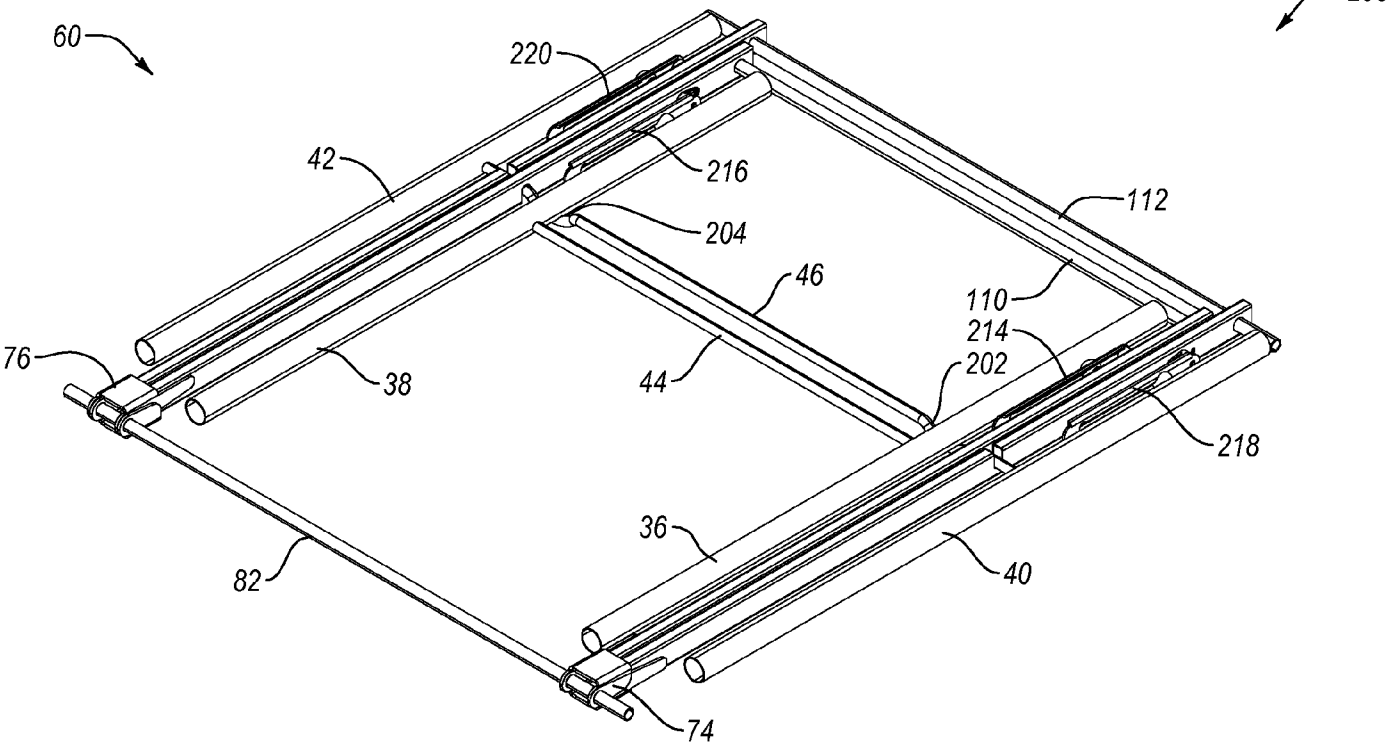
FIG. 17 is a perspective view of the frame shown in FIG. 15, illustrating the frame in a folded position.
Figure 18:
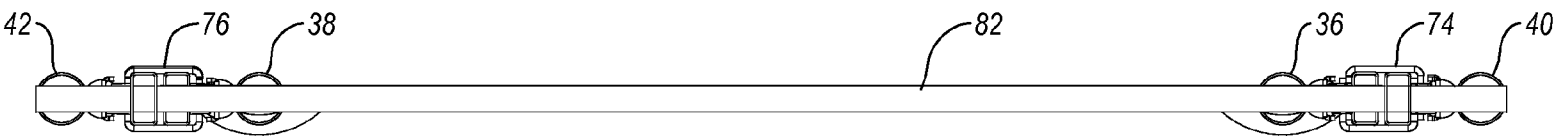
FIG. 18 is a front view of the frame shown in FIG. 17.
Figure 19:
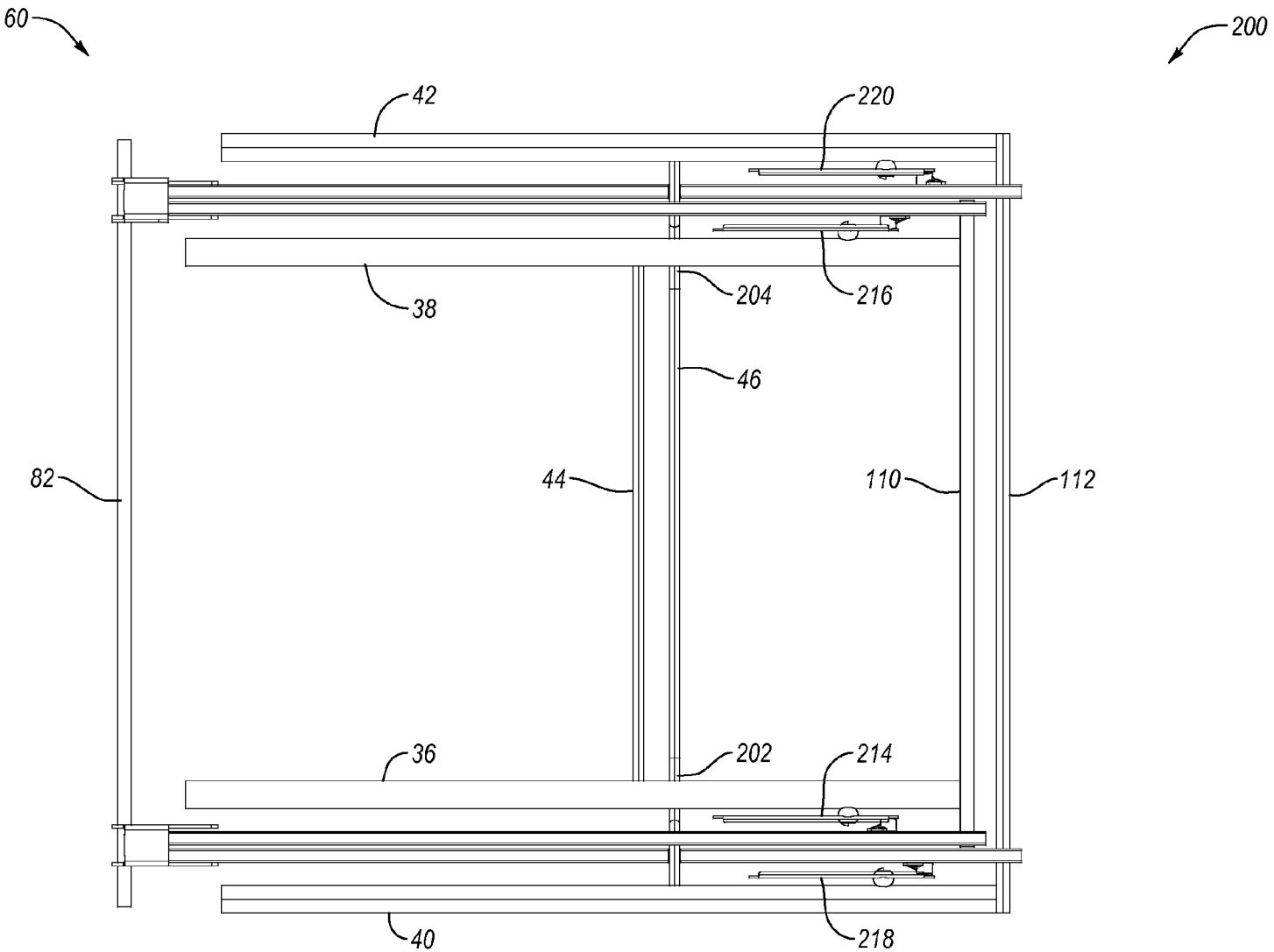
FIG. 19 is a top view of the frame shown in FIG. 17.

The frame 60 is preferably sized and configured to allow the table 200 to be folded into a compact configuration. For example, as shown in FIGS. 15 and 16, the first portions 66, 70 of the first and second side rails 62, 64 may be disposed inwardly relative to the second portions 68, 72 of the side rails. Thus, the first portions 66, 70 of the side rails 62, 64 may be connected to the inner portions of the hinge assemblies 74, 76 and the second portions 68, 72 of the side rails may be connected to the outer portions of the hinge assemblies. Therefore, when the frame 60 is in the folded position as shown in FIGS. 17-19, the first portions 66, 70 of the side rails 62, 64 may be disposed inside the second portions 68, 72 of the side rails.

In greater detail, the supports 36, 38 are preferably disposed inside the first portions 66, 70 of the side rails 62, 64 and the braces 214, 216 are also preferably disposed inside the first portions of the side rails. Thus, when the leg assembly 32 is preferably disposed between the first portions 66, 70 of the side rails 62, 64 when the leg assembly is in the folded position. On the other hand, the supports 40, 42 and the braces 218, 220 are preferably disposed outside the second portions 68, 72 of the first and second side rails 62, 64. Therefore, when the leg assembly 34 is in the closed position, the supports 40, 42 may be disposed outside the second portions 68, 72 of the side rails 62, 64.

When the frame 60 for the table 200 is in the folded position, the connecting member 46 may be disposed in the receiving portions 206, 208, 210, 212. For example, if the leg assembly 34 is disposed in the folded position, the connecting member may be disposed in the receiving portions 210, 212 in the second portions 68, 72 of the side rails 62, 64. When the frame 60 is then folded together, the connecting member 46 may be disposed in the receiving portions 206, 208 in the first portions 66, 70 of the side rails. In addition, the supports 36, 38 may be disposed in the receiving portions 204, 206 in the connecting member. Therefore, the frame 60 of the table 200 may have a compact configuration in the folded position because the leg supports 36, 38, 40, 42 and the first and second portions of the side rails are offset.

The frame 60 of the table 200 may also have a compact configuration because none of the major components are vertically stacked in the folded configuration. In contrast, the major components are horizontally disposed to minimize the height of the frame. For instance, the first and second portions 66, 68 of the side rail 62 may be horizontally disposed between the leg supports 36, 40 when the frame is folded. In addition, the braces 214, 218 may be disposed between the leg supports 36, 40 when the frame is folded. In fact, the first and second portions 66, 68 of the side rail 62 and the braces 214, 218 may be disposed between the leg supports 36, 40. Similarly, the first and second portions 70, 72 of the side rail 64 and/or the braces 216, 220 may be disposed between the leg supports 38, 42 when the frame is folded. This positioning, arrangement and alignment of the supports 36, 38, 40, 42; the first and second portions 66, 68, 70, 72 of the side rails 62, 64; and/or the braces 214, 216, 218, 220 may be important in creating a table with a compact configuration in the folded position.

Advantageously, the features described above may allow a table to be disposed in a more compact configuration in the folded position than a conventional folding table. For example, assuming other relevant factors are not changed, the strength and rigidity of a table may be directly proportional to the height and width of the side rails of the frame. Therefore, decreasing the height and/or width of the side rails may decrease the strength and/or rigidity of the table. Significantly, the features described above may allow a table to have side rails that are generally the same height and width as the side rails of a conventional folding table, but the table may be folded into a more compact configuration. In particular, because the side rails 62, 64 of the table 10, 200 may have generally the same height and width as the side rails of a conventional table, the more compact folding table may have generally the same strength, rigidity and other characteristics as a conventional folding table. In addition, because the frame 60 of the more compact folding table 10, 200 may have generally the same shape and size as the frame of a conventional folding table, the more compact folding table may have the same general strength, rigidity and characteristics of a conventional folding table. Importantly, because the more compact folding table 10, 200 may have side rails 62, 64 with generally the same size and shape as a conventional folding table, consumers and retailers may readily assume the tables have comparable strength and rigidity, especially if other relevant factors are the same or comparable.

The table 10, 200 may have generally the same strength, rigidity and other characteristics as a conventional table because the height and width of the side rails 62, 64 and/or the frame 60 may be relatively unchanged. The table 10, 200 may also be disposed in a more compact configuration because of the features described above. Significantly, this may allow the table 10, 200 to be more efficiently packaged, stored and/or transported. For example, because the leg assemblies 32, 34; leg supports 36, 38, 40, 42; side rails 62, 64; and/or braces 122, 128 may be offset, the height of the table 10, 200 in the folded position may be about seventeen percent (17%) less than the height of a conventional folding table. For instance, a conventional folding table may have first and second halves with a height of about 1.5 inches. Thus, a conventional folding table has a height of at least 3.0 inches in the folded position. The features described above may allow the folding table 10, 200 to have first and second sections 48, 50 that have a height of about 1.5 inches and with similar strength, rigidity and characteristics as a conventional folding table, but with a thickness of about 2.5 inches in the folded position. Therefore, the table 10, 200 may have a height in the folded position that is about 83% of the height of a conventional folding table, which may allow six tables with a thickness of about 2.5 inches in the folded position to be disposed in the same space as five tables with a thickness of about 3.0 inches. This ratio of about 6:5 may also allow twenty-four tables including one or more of these features described above to be disposed in the same space as twenty tables with a thickness of about 3.0 inches. As will be appreciated by one of ordinary skill in the art after reading the disclosure herein, this 17% decrease in height may allow significant savings in space, transportation and storage. In summary, the features disclosed above may allow a plurality of tables to be more efficiently stored, stacked, shipped, packaged and transported. This may allow transportation costs to be decreased and allow retailers to more efficiently store and display the tables. Further, this may allow businesses, consumers and purchasers to save a considerable amount of space when storing or transporting the tables 10, 200.

One of ordinary skill in the art may appreciate after reviewing this disclosure that the tables 10, 200 and accompanying components may have various shapes, sizes, configurations and arrangements depending, for example, upon the intended use of the table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A folding table that is capable of being disposed in a folded position and an unfolded position, the folding table comprising:

a first section of a table top;

a second section of a table top;

a first portion of a first side rail connected to the first section of the table top;

a second portion of the first side rail connected to the second section of the table top; and a hinge assembly connecting the first portion and the second portion of the first side rail in an offset configuration with the first portion of the first side rail generally disposed in a first plane and the second portion of the first side rail generally disposed in a second plane, the first plane and the second plane aligned along a length of the table top and spaced apart by a distance, the hinge assembly comprising:

a first portion of the hinge assembly connected to an end of the first portion of the first side rail; and a second portion of the hinge assembly connected to an end of the second portion of the first side rail, the end of the first portion of the first side rail and the end of the second portion of the first side rail disposed at least proximate and aligned along a width of the table top when the table is in the folded position;

wherein an inner surface of the first portion of the first side rail is disposed at least proximate an outer surface of the second portion of the first side rail when the table is in the folded position.

2. The folding table as in claim 1, wherein the hinge assembly comprises:

a first bracket including a flange connected to an outer surface of the first portion of the first side rail; and a second bracket including a flange connected to an inner surface of the second portion of the first side rail, the flange of the first bracket and the flange of the second bracket being spaced apart by a distance to allow the first portion and the second portion of the first side rail to be disposed in the offset configuration.

3. The folding table as in claim 1, wherein when the table is in the folded position, a lower surface of the first portion of the first side rail is disposed at least proximate a lower surface of the second section of the table top; and wherein when the table is in the folded position, a lower surface of the second portion of the first side rail is disposed at least proximate a lower surface of the first section of the table top.

4. The folding table as in claim 1, wherein the hinge assembly comprises a body, a first flange connected to the first portion of the first side rail and a second flange connected to a second portion of the first side rail, the body having a width generally equal to a width of the first portion and the second portion of the first side rail.

5. The folding table as in claim 1, further comprising:

a first leg assembly connected to the first section of the table top by a first cross member, the first leg assembly movable between an extended position and a collapsed position relative to the table top;

a second leg assembly connected to the second section of the table top by a second cross member, the second leg assembly movable between an extended position and a collapsed position relative to the table top;

an inwardly extending receiving portion in the first cross member that receives a portion of the second portion of the first side rail when the table is in the folded position; and an inwardly extending receiving portion in the second cross member that receives a portion of the first portion of the first side rail when the table is in the folded position.

6. The folding table as in claim 5, wherein the receiving portion in the first cross member faces in an opposite direction from a lower surface of the first section of the table top when the first leg assembly is disposed in the collapsed position; and wherein the receiving portion in the first cross member faces towards an end of the first section of the table top when the first leg assembly is disposed in the extended position.

7. The folding table as in claim 1, further comprising:

a first portion of a second side rail connected to the first section of the table top;

a second portion of the second side rail connected to the second section of the table top;

a second hinge assembly connecting the first portion and the second portion of the second side rail in an offset configuration;

a first leg assembly connected to the first side rail and the second side rail by a first cross member, the first leg assembly movable between an extended position and a collapsed position relative to the table top;

a second leg assembly connected to the first side rail and the second side rail by a second cross member, the second leg assembly movable between an extended position and a collapsed position relative to the table top;

a first inwardly extending receiving portion in the first cross member that receives a portion of the first side rail when the table is in the folded position; and a second inwardly extending receiving portion in the first cross member that receives a portion of the second side rail when the table is in the folded position.

8. The folding table as in claim 7, further comprising:

a first inwardly extending receiving portion in the second cross member that receives a portion of the first side rail when the table is in the folded position; and a second inwardly extending receiving portion in the second cross member that receives a portion of the second side rail when the table is in the folded position.

9. The folding table as in claim 8, wherein the first receiving portion of the first cross bar is disposed between the first portion of the first side rail and the first leg assembly; and wherein the second receiving portion of the first cross bar is disposed proximate an outer surface of the first portion of the second side rail.

10. The folding table as in claim 7, wherein the first portion and the second portion of the first side rail are offset by a distance when the table is in the folded position, the distance measured along a width of the table top; and wherein the first portion and the second portion of the second side rail are offset by generally the same distance when the table is in the folded position as the first portion and the second portion of the first side rail.

11. A folding table that is capable of being disposed in a folded position and an unfolded position, the folding table comprising:

a table top comprising:

a first section; and a second section;

a frame comprising:

a first side rail including a first portion connected to the first section of the table top and a second portion connected to the second section of the table top, the first portion and the second portion of the first side rail connected in an offset configuration by a first hinge assembly, a sidewall of the first portion of the first side rail being disposed at least proximate a sidewall of the second portion of the first side rail when the table is in the folded position;

a second side rail including a first portion connected to the first section of the table top and a second portion connected to the second section of the table top, the first portion and the second portion connected in an offset configuration by a second hinge assembly, a sidewall of the first portion of the second side rail being disposed at least proximate a sidewall of the second portion of the second side rail when the table is in the folded position;

a first leg assembly movable relative to the first section of the table top between an extended position and a collapsed position;

a second leg assembly movable relative to the second section of the table top between an extended position and a collapsed position; and a first cross member connected to the first side rail and the second side rail, the first cross member comprising:

a first inwardly extending receiving portion that receives a portion of the first side rail when the table is in the folded position; and a second inwardly extending receiving portion that receives a portion of the second side rail when the table is in the folded position.

12. The folding table as in claim 11, wherein the first cross member connects the first leg assembly to the first portion of the first side rail and the first portion of the second side rail; and further comprising a second cross member connecting the second leg assembly to the second portion of the first side rail and the second portion of the second side rail.

13. The folding table as in claim 12, further comprising:

a first receiving portion in the second cross member that receives a portion of the first side rail when the table is in the folded position; and a second receiving portion in the second cross member that receives a portion of the second side rail when the table is in the folded position.

14. The folding table as in claim 12, wherein the first receiving portion of the first cross member is disposed between the first portion of the first side rail and the first leg assembly; and wherein the second receiving portion of the first cross member is disposed proximate an outer surface of the first portion of the second side rail.

15. The folding table as in claim 12, wherein the first portion of the first side rail, the first leg assembly and the first portion of the second side rail are offset from the second portion of the first side rail, the second leg assembly and the second portion of the second side rail by a generally constant distance.

16. The folding table as in claim 11, wherein the first leg assembly is connected to the first side rail and the second side rail and the first cross member is disposed between the first leg assembly and a central cross member.

17. The folding table as in claim 11, wherein an inwardly facing sidewall of the first portion of the first side rail is disposed at least proximate an outwardly facing sidewall of the second portion of the first side rail when the table is in the folded position; and wherein an outwardly facing sidewall of the first portion of the second side rail is disposed at least proximate an inwardly facing sidewall of the second portion of the first side rail when the table is in the folded position.

18. The folding table as in claim 11, wherein an outwardly facing sidewall of the first portion of the first side rail is disposed at least proximate an inwardly facing sidewall of the second portion of the first side rail when the table is in the folded position; and wherein an outwardly facing sidewall of the first portion of the second side rail is disposed at least proximate an inwardly facing sidewall of the second portion of the second side rail when the table is in the folded position.

19. The folding table as in claim 11, wherein the first hinge assembly comprises:

a first bracket including a flange connected to an outer surface of the first portion of the first side rail; and a second bracket including a flange connected to an inner surface of the second portion of the first side rail, the flange of the first bracket and the flange of the second bracket being spaced apart by a distance to allow the first portion and the second portion of the first side rail to be disposed in an offset configuration; and wherein the second hinge assembly comprises:

a first bracket including a flange connected to an outer surface of the first portion of the second side rail; and a second bracket including a flange connected to an inner surface of the second portion of the second side rail, the flange of the first bracket and the flange of the second bracket being spaced apart by a distance to allow the first portion and the second portion of the second side rail to be disposed in an offset configuration.

20. The folding table as in claim 11, wherein when the table is in the folded position, a lower surface of the first portion of the first side rail is disposed at least proximate a lower surface of the second section of the table top;

wherein when the table is in the folded position, a lower surface of the second portion of the first side rail is disposed at least proximate a lower surface of the first section of the table top;

wherein when the table is in the folded position, a lower surface of the first portion of the second side rail is disposed at least proximate the lower surface of the second section of the table top; and wherein when the table is in the folded position, a lower surface of the second portion of the second side rail is disposed at least proximate the lower surface of the first section of the table top.

* * * * *

UNITED STATES PATENT AND TRADEMARK OFFICE

CERTIFICATE OF CORRECTION

PATENT NO. : 8,555,790 B2
APPLICATION NO. : 13/195801
DATED : October 15, 2013
INVENTOR(S) : Winter et al.

It is certified that error appears in the above-identified patent and that said Letters Patent is hereby corrected as shown below:

In the Specification

In Column 9, Line 44, delete "table to 12" and insert -- table top 12 --, therefor.

Signed and Sealed this
Twenty-sixth Day of November, 2013

Margaret A. Focarino

Margaret A. Focarino
*Commissioner for Patents of the United States Patent and Trademark Office*